US010286714B2

(12) United States Patent
Nelson et al.

(10) Patent No.: US 10,286,714 B2
(45) **Date of Patent: *May 14, 2019**

(54) CASE FOR AUTHENTICATED COMIC BOOK

(71) Applicant: Certified Guaranty Company, LLC, Lakewood Ranch, FL (US)

(72) Inventors: Matthew Aaron Nelson, Lakewood Ranch, FL (US); Harshen Patel, Lakewood Ranch, FL (US); Joseph R Yanarella, Jr., Wellington, FL (US); Stephen Lam, Hong Kong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/838,339

(22) Filed: Dec. 11, 2017

(65) Prior Publication Data

US 2018/0201042 A1 Jul. 19, 2018

Related U.S. Application Data

(63) Continuation of application No. 15/063,427, filed on Mar. 7, 2016, now Pat. No. 9,840,106, which is a (Continued)

(51) Int. Cl.
*B65D 25/10* (2006.01)
*B42D 3/12* (2006.01)
(Continued)

(52) U.S. Cl.
CPC ..... *B42D 3/12* (2013.01); *B42D 3/045* (2013.01); *B65D 11/10* (2013.01); *B65D 25/10* (2013.01); *B65D 25/54* (2013.01)

(58) Field of Classification Search
CPC ..... B42D 3/12; B42D 3/045; B65D 25/10; B65D 25/20; B65D 25/54; B65D 81/02;
(Continued)

(56) References Cited

U.S. PATENT DOCUMENTS 3,415,407 A * 12/1968 Alden ..... B65D 25/205 206/459.5
4,915,214 A * 4/1990 Wieder ..... A47G 1/12 206/459.5
(Continued)

FOREIGN PATENT DOCUMENTS

CA 2 391 044 A1 8/2000

OTHER PUBLICATIONS

Notice of Allowance received in corresponding U.S. Appl. No. 15/063,427, dated Aug. 15, 2017, 5 pages.
(Continued)

*Primary Examiner* — Bryon P Gehman
(74) *Attorney, Agent, or Firm* — Patent GC LLC; Alexander Franco

(57) ABSTRACT

A comic book case includes a base and a cover configured to compress and secure a comic book in place under frictional pressure such that the book cannot easily shift or slip within the case. Prior art cases that included walls surrounding the top, bottom and side edges of a book typically allowed some free movement or slippage of the book between the walls. This movement or slippage could result in damage such as curling or crinkling of the edges of the book if the case were exposed to a physical shock, such as by being dropped. The base includes a raised base platform and the cover includes a depressed cover platform, which extends towards the base platform to create a space within which the book is securely held.

20 Claims, 26 Drawing Sheets

Related U.S. Application Data continuation-in-part of application No. 29/557,254, filed on Mar. 7, 2016, which is a continuation-in-part of application No. 29/557,255, filed on Mar. 7, 2016.

(51) Int. Cl.

| | |
|---|---|
| ***B65D 25/54*** | (2006.01) |
| ***B42D 3/04*** | (2006.01) |
| ***B65D 6/00*** | (2006.01) |

(58) Field of Classification Search

CPC ..... B65D 81/26; B65D 85/00; B65D 85/48; B65D 11/10; G09F 1/10; G09F 1/12

USPC ..... 206/232, 424, 449, 454, 455, 459.1, 206/459.5; 40/312, 661

See application file for complete search history.

(56) References Cited

U.S. PATENT DOCUMENTS

| | | | | |
|---|---|---|---|---|
| 5,097,953 | A * | 3/1992 | Gingras | G09F 1/10 206/449 |
| 5,353,925 | A * | 10/1994 | Lennen | B65D 81/266 206/424 |
| 5,415,290 | A | 5/1995 | Merkley et al. | |
| 5,429,238 | A * | 7/1995 | Fritz | B42F 7/025 206/424 |
| 6,102,207 | A * | 8/2000 | Carse | B65D 85/00 206/459.1 |
| 6,149,003 | A | 11/2000 | Day | |
| 6,308,831 | B1 * | 10/2001 | Saxe | G09F 1/12 206/449 |
| D469,963 | S | 2/2003 | Ueno | |
| D494,632 | S | 8/2004 | Gladstone | |
| 8,011,510 | B1 * | 9/2011 | Smith, II | B65D 43/162 206/449 |
| 9,380,892 | B2 | 7/2016 | Kallinger | |
| 9,758,288 | B2 * | 9/2017 | Bornstein | B65D 81/02 |
| 9,840,106 | B2 | 12/2017 | Nelson et al. | |
| D816,149 | S | 4/2018 | Dalton | |
| 2007/0187266 | A1 * | 8/2007 | Porter | A63F 1/02 206/232 |
| 2016/0145027 | A1 | 5/2016 | Bornstein | |
| 2017/0253067 | A1 | 9/2017 | Nelson et al. | |

OTHER PUBLICATIONS

Non-Final Office Action Received for U.S. Appl. No. 15/063,427, dated Apr. 13, 2017, 9 Pages.

Non-Final Office Action Received for U.S. Appl. No. 29/557,254, dated Jun. 12, 2018, 6 Pages.

Non-Final Office Action Received for U.S. Appl. No. 29/557,255, dated Jun. 12, 2018, 6 Pages.

Notice of Allowance received in corresponding U.S. Appl. No. 29/599,297, dated Jul. 3, 2018, 7 pages.

* cited by examiner

CASE FOR AUTHENTICATED COMIC BOOK

RELATED APPLICATIONS

The subject matter of this application is related to U.S. Design patent application No. 29/557,254 filed Mar. 7, 2016, titled "CASE FOR AUTHENTICATED COMIC BOOK", U.S. Design patent application No. 29/557,255 filed Mar. 7, 2016, titled "CASE FOR AUTHENTICATED COMIC BOOK", and U.S. Utility patent application Ser. No. 15/063,427 filed Mar. 7, 2016, now U.S. Pat. No. 9,840,106, titled "CASE FOR AUTHENTICATED COMIC BOOK", all of which applications are hereby incorporated by reference in their entireties.

BACKGROUND OF THE INVENTION

Comic books and other collectible items such as books and magazines are bought and sold at trade shows and collectible item dealer stores. In addition, collectible items are increasingly being transacted over the Internet. In these types of transactions, purchasers are concerned that the item purchased is not authentic and/or not accurately described or graded. There exist commercial services that authenticate, grade, and encapsulate comic books submitted by owners. Once a comic book is graded, the service encapsulates the book within a tamper-evident transparent plastic case with a certificate indicating the description and grade of the book. The graded and encapsulated book, which is then returned by the service to its owner, becomes a more marketable item than one that is not graded and encapsulated.

In addition to establishing authenticity and grade, comic book cases also protect books from wear and tear. Damage can occur, for example, during shipping of a book that is otherwise not protected by a case. U.S. Pat. No. 5,415,290 describes a comic book protection cover system including an open ended bag formed of thin flexible transparent polypropylene and a rectangular rigid transparent insert. Space remains in the bag for receipt of the comic book adjacent the insert. U.S. Pat. No. 5,353,925 describes a preservation device for a collectible article in which a front and back panel define a cavity for receiving the collectible article. A spacing sheet positioned between the front and back panels creates a channel around the article. A gaseous substance is circulated around the channel. The gaseous substance is exposed to a desiccant for removing moisture. Screws are used to secure the back panel to the front panel. The article can be removed from the preservation device by unscrewing the screws.

U.S. Pat. No. 6,102,207 describes a collectible article holder providing readily observable positive evidence if tampering of the holder has occurred, thereby indicating that the item contained in the holder is authentic. The collectible article, such as a comic book, is placed in a core. Means for authenticating the collectible article is coupled to the core. The core is received in a cavity formed between a top and a bottom of a case. The top and bottom are ultrasonically bonded together. The case is designed to include means for positively indicating sealing of the top to the bottom which means form a visible irreparable condition of the case indicative of tampering. Key slots are formed in the side of the case to allow a purchaser after purchasing the collectible article to insert a tool, such as a screwdriver, in order to open the case. After the case is opened, the core layers can be peeled apart for allowing the purchaser to handle the collectible article. It will be appreciated that after the case has been opened, the collectible article is no longer certified as authentic.

SUMMARY OF THE INVENTION

A comic book case includes a base and a cover configured to compress and secure a comic book in place under frictional pressure such that the book cannot easily shift or slip within the case. Prior art cases that included walls surrounding the top, bottom and side edges of a book typically allowed some free movement or slippage of the book between the walls. This movement or slippage could result in damage such as curling or crinkling of the edges of the book if the case were exposed to a physical shock, such as by being dropped. The base includes a raised base platform and the cover includes a depressed cover platform, which extends towards the base platform to create a space within which the book is securely held. Appropriately configured and sized bases and/or covers can be used to account for the necessary space to provide adequate frictional pressure for different thicknesses of books. In addition to comic books, the case can be configured in different shapes and sizes to hold other types of books, magazines, pamphlets, documents, or other types of articles. In accordance with different embodiments, the case can be configured with an appropriate size and shape to encapsulate substantially any flat article.

To assemble the case, a book, optionally enclosed in a clear plastic envelope bag, is placed on the base platform, and a certificate is placed on a certificate platform. The cover is placed over the base such that a set of posts extending up from the base are received in a corresponding set of receptacles in the cover. The engagement of the posts and receptacles, such as by friction or deformation of the posts and/or receptacles upon engagement, can provide tension to at least temporarily hold the cover to the base. The temporarily assembled case can then be permanently or semi-permanently assembled using ultrasonic bonding around part of all of mating surfaces on the base and cover which extend around the perimeter of the case. Ultrasonic bonding can also or alternatively be used to bond the posts to the receptacles, which can provide a visual indication of tampering if the bond between the posts and receptacles is broken or if the posts and/or receptacles themselves are broken.

DETAILED DESCRIPTION

In the following description, reference is made to the accompanying drawings, which form a part hereof, and which show, by way of illustration, specific embodiments or processes in which the invention may be practiced. Where possible, the same reference numbers are used throughout the drawings to refer to the same or like components. In some instances, numerous specific details are set forth in order to provide a thorough understanding of the present invention. The present invention, however, may be practiced without the specific details or with certain alternative equivalent devices, components, and methods to those described herein. In other instances, well-known devices, components, and methods have not been described in detail so as not to unnecessarily obscure aspects of the present invention.

Figure 1:
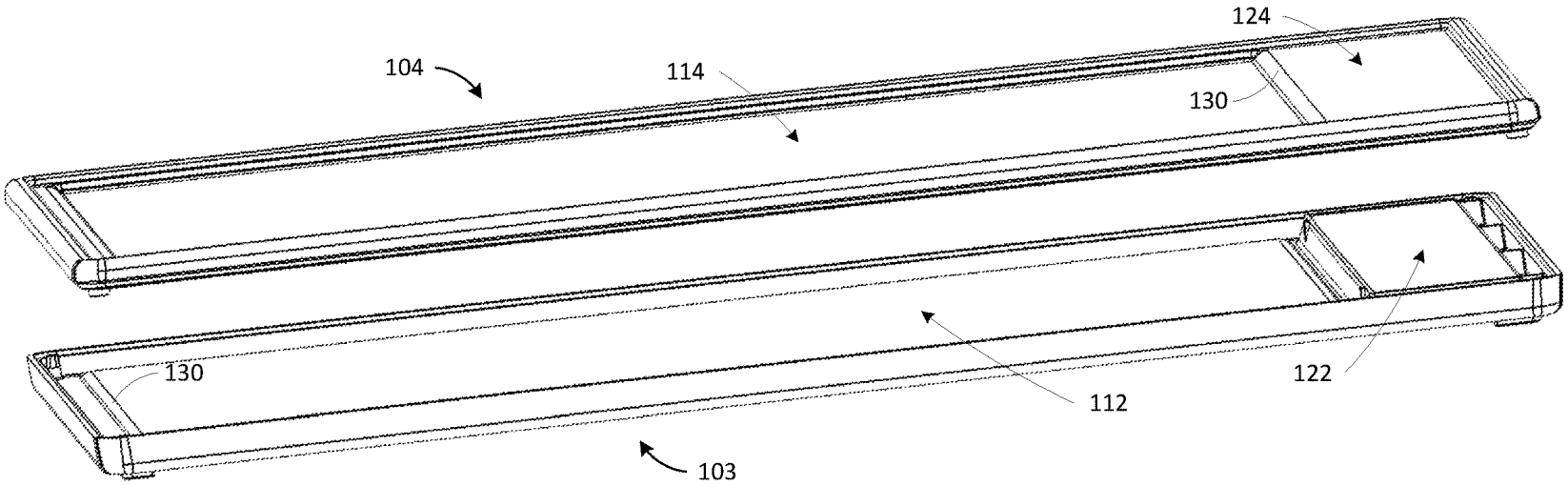
FIG. 1 illustrates an exploded view of a comic book case from a lower right side perspective in accordance with one embodiment.

FIG. 1 illustrates an exploded view of a comic book case from a lower right side perspective in accordance with one embodiment. The case includes a base 102 and a cover 104, which are preferably each constructed of clear transparent rigid plastic. The base 102 and cover 104 can each be created, for example, using known injection molding processes.

Figure 2:
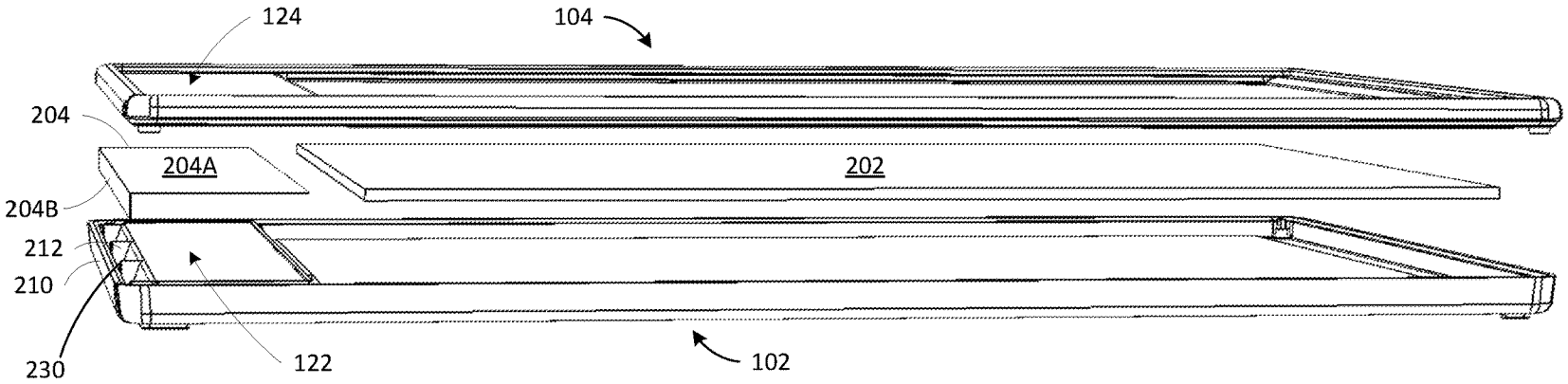
FIG. 2 illustrates a second exploded perspective view of the case from an upper left side perspective.

FIG. 2 illustrates a second exploded perspective view of the case from an upper left side perspective. The exploded view of FIG. 2 further shows a comic book 202 and a certificate 204 in relative position above where they would rest within the base 102. The comic book 202 will typically include bound printed material with a thickness between 1 mm and 5 mm, and different thickness books can be accommodated by varying the depth and configuration of the base 102 and/or cover 104 in accordance with different embodiments. As will be noted from the drawings, the book 202 and the certificate 204 are only shown in FIG. 2 and have been omitted from the remaining figures to more clearly illustrate the features of the base 102 and the cover 104.

Referring to FIG. 1, when the case is assembled, the book 202 is compressed and held in place between an upper surface of a base platform 112 of the base 102 and a lower surface of a cover platform 114 of the cover 104. The base platform 112 can be raised by way of steps 130 on 2 or more sides relative to surrounding portions of the base 102. The cover platform 114 can be depressed by way of steps 130 on 2 or more sides relative to a surrounding upper portion 2020 (FIG. 20) of the cover 104. The raised base platform 112 and depressed cover platform 114 are shown more clearly in subsequent figures such as the cut-away perspective view of FIG. 24C. The steps 130 that partially or completely circumscribe the base platform 112 and the cover platform 114 can function to counter deflection or bowing of the platforms by pressure exerted by the book on the platforms when the case is assembled. In accordance with one embodiment, the base 102 and the cover 104 are permanently assembled using ultrasonic bonding that surrounds part or all of the perimeters of the components.

Referring to FIG. 2, the case also includes a certificate 204 marked with a description of the book. In one embodiment, the certificate is made of heavy stock paper that is scored, by cutting partially through the paper's thickness, and folded along the score at a right angle. The fold creates a larger face portion 204A and smaller tab portion 204B of the certificate 204.

When the case is assembled, the face portion 204A of the certificate 204 rests on an upper surface of a certificate platform 122 of the base 102. The face portion 204A can be viewed through a certificate window 124 of the cover 104. The certificate platform 122 can be optionally integrated into or made a part of the base platform 112, such that the top surface of the certificate platform 122 and the base platform 112 lie in the same plane. The certificate platform 122 can be substantially separate from the base platform 112, with one or more steps up and/or down between the platforms, such that the top surface of the certificate platform 122 and the base platform 112 lie in different planes.

When the case is assembled, the tab portion 204B is fitted in a slot 230 (shown more clearly in FIG. 18) formed between a top wall 210 of the base 102 and a number of vertically aligned fins 212 that extend outward from the certificate platform 122. Both the face portion 204A and the tab portion 204B can include information identifying the book, such as a title, series and version. The face portion 204A has additional space on which to include certification indicia and a grading indicating the condition of the book. When the tab portion 204B is inserted into the slot 230 within the assembled case, the information on the tab portion can be viewed through the top wall 210 of the base 102. In one embodiment, a separate label or certificate can be used instead of the tab portion 204B. In one embodiment, one or more additional slots 230 can be formed on additional sides of the case, such as on the bottom, to accommodate additional labels.

In additional embodiments, one or more of the base platform 112, the cover platform 114, and the certificate platform 122 can be omitted in favor of a flat non-platform window panel that is not raised or depressed relative to the surrounding portions of the base 102 or cover 104.

Figure 3:
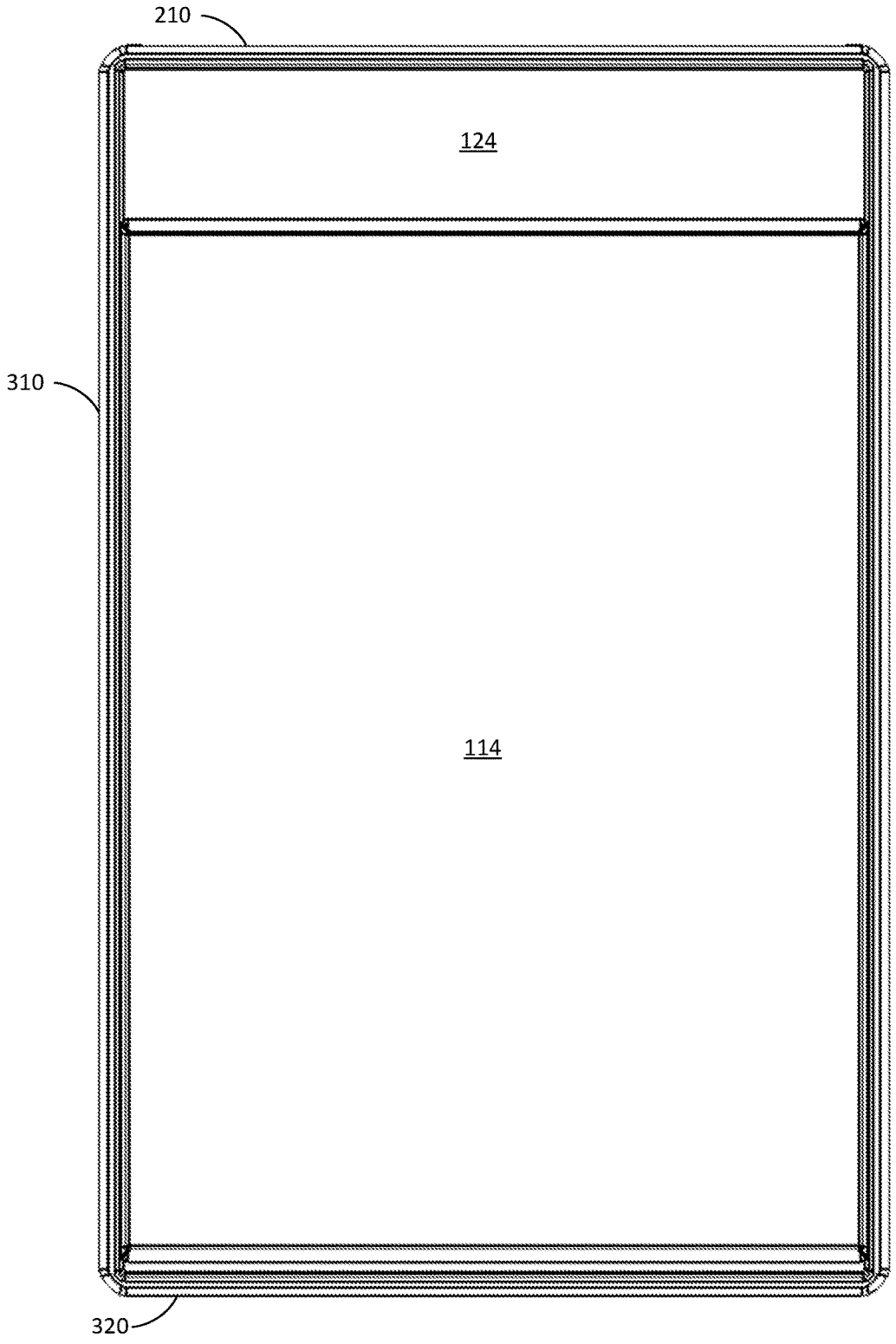
FIG. 3 illustrates a front elevation view of the assembled case.

FIG. 3 illustrates a front elevation view of the assembled case. The base 102 and cover 104 are assembled such that the case has a top wall 210, two side walls 310, and a bottom wall 320.

Figure 4A:
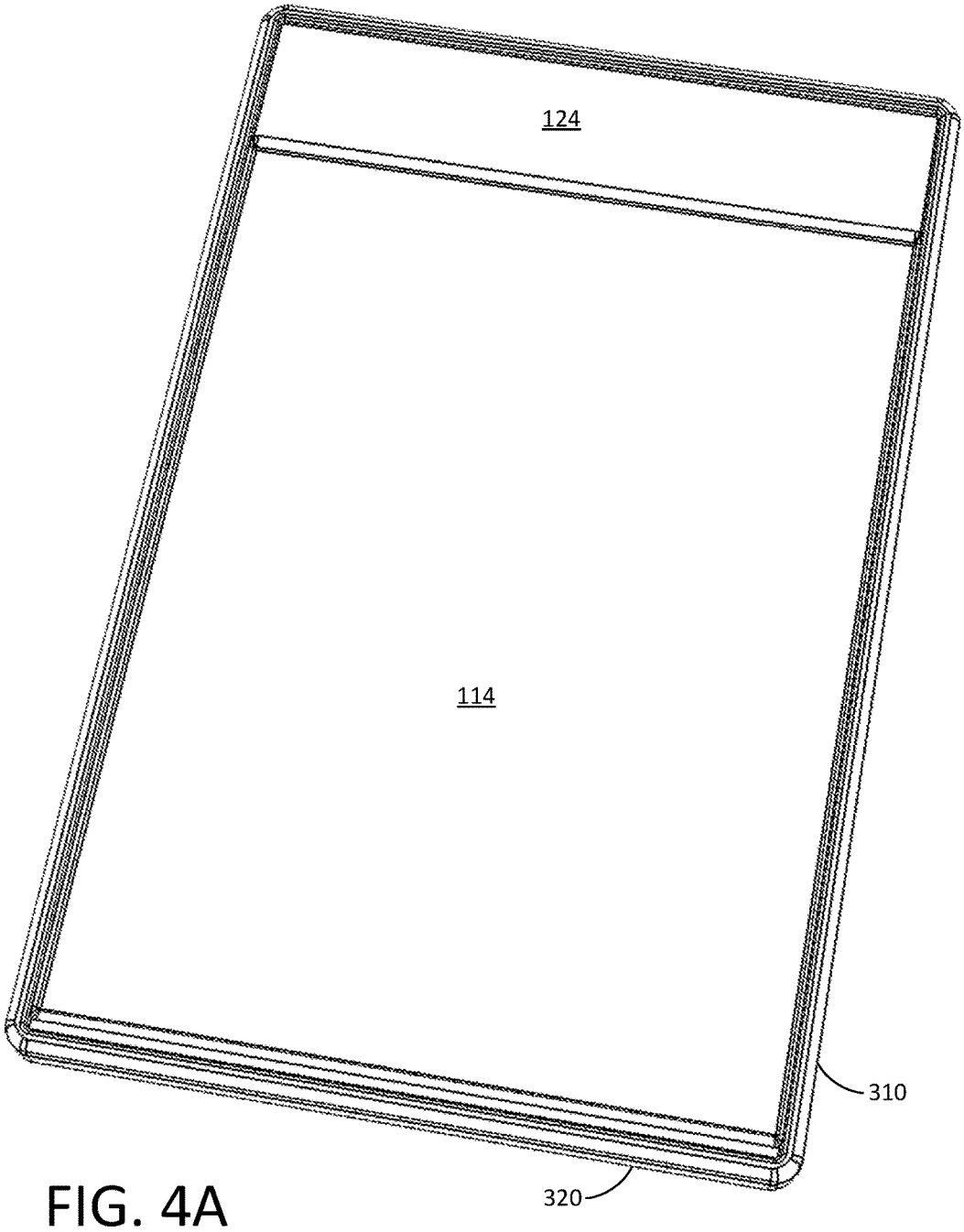
FIG. 4A illustrates a high perspective view of the assembled case from a lower right side.
Figure 4B:
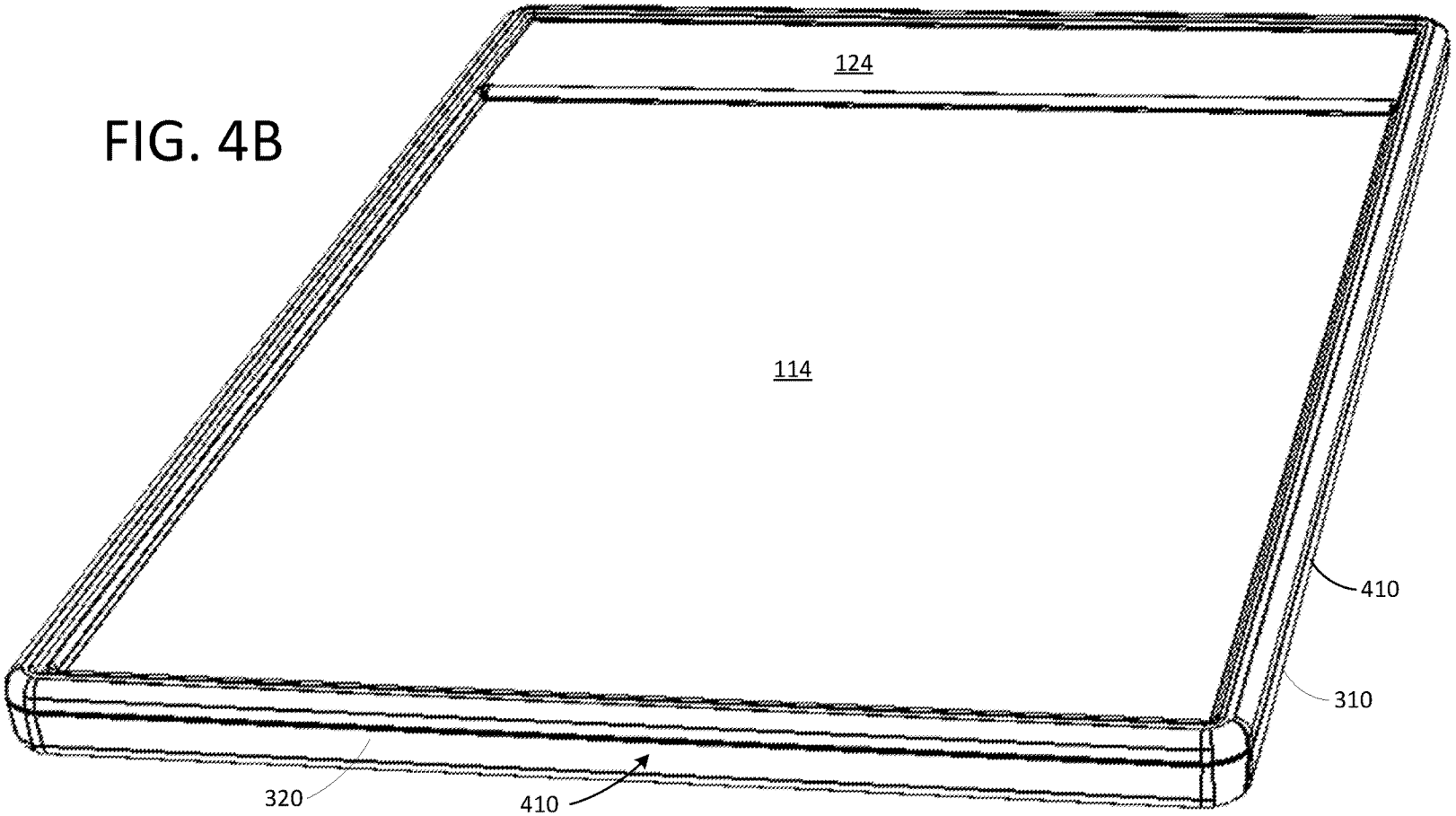
FIG. 4B illustrates a low perspective view of the assembled case from the lower right side.
Figure 4C:
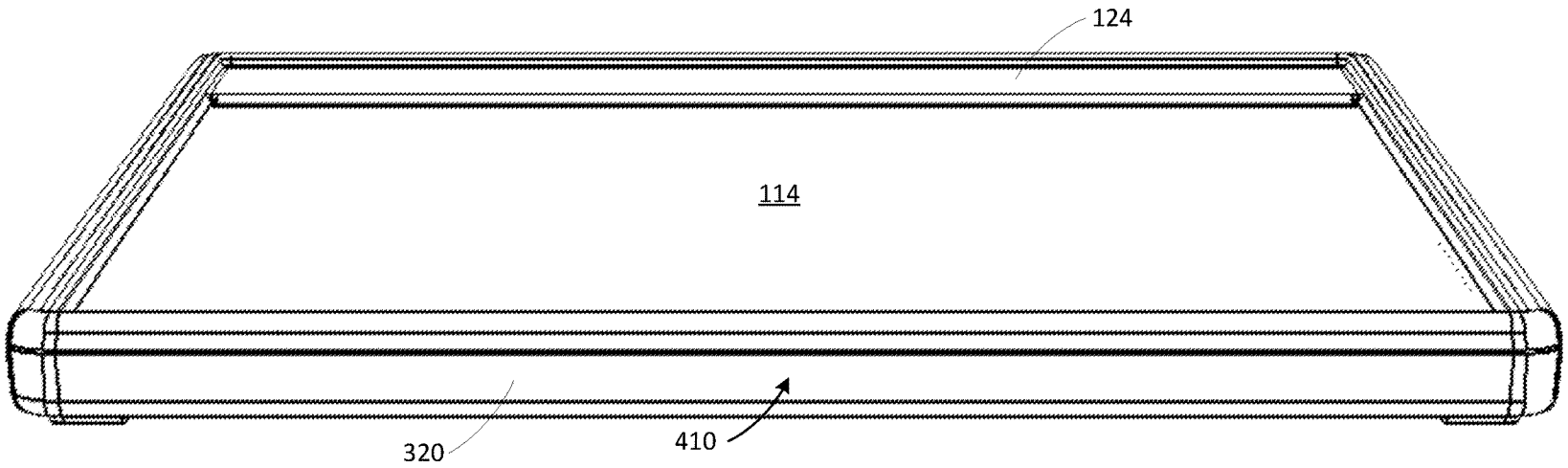
FIG. 4C illustrates a low perspective view of the assembled case from the bottom side.

FIG. 4A illustrates a high perspective view of the assembled case from a lower right side. FIG. 4B illustrates a low perspective view of the assembled case from the lower right side. FIG. 4C illustrates a low perspective view of the assembled case from the bottom side.

FIG. 4B also shows an outer wall 410, which bounds the perimeter of the case and which includes the top wall 210, two side walls 310, and bottom wall 320. The outer wall 410 can be formed in part by each of the base 102 and the cover 104, depending on how high the joint or break between the base 102 and cover 104 is positioned. In the illustrated embodiments, most of the outer wall 410 is formed by the base 102. In additional embodiments, most of the outer wall 410 can be formed by the cover 104, with the joint between the base 102 and the cover being located closer to the bottom of the base 102.

Figure 5:
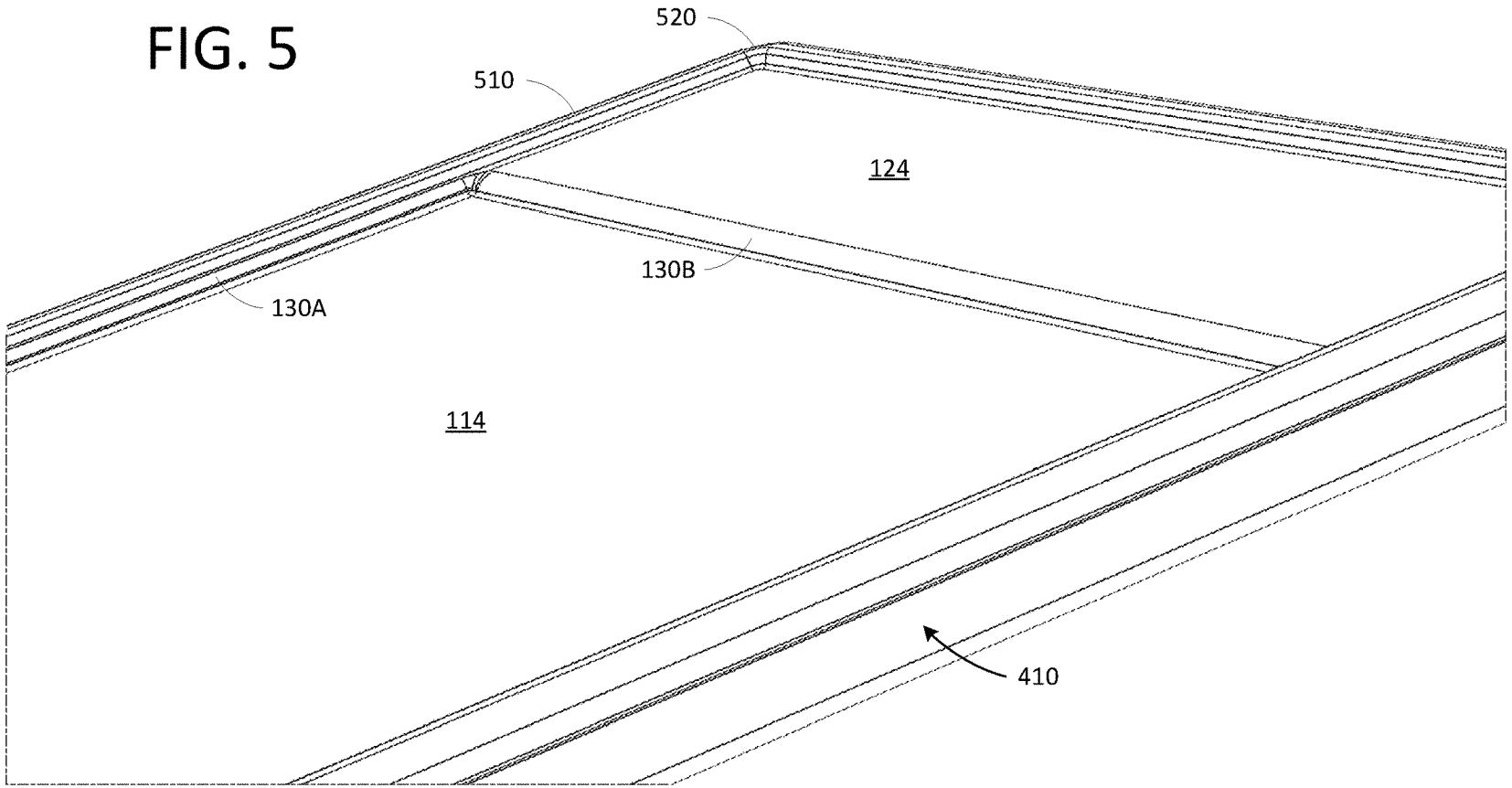
FIG. 5 illustrates a close perspective view showing detail of the upper left portion of the cover.

FIG. 5 illustrates a close perspective view showing detail of the upper left portion of the cover 104. Two steps 130A and 130B that form the upper and left side portions of the depressed cover platform 114 are visible. FIG. 5 also illustrates how the both the depressed cover platform 114 and the certificate window 124 can are positioned lower relative to an outer ridge 510 of the cover 104 in one embodiment.

In one embodiment, the outer ridge 510 defines four corner features 520, where the ridge takes turns around the perimeter of the case. The four corner features 520 facilitate stacking of multiple cases as will be discussed below with reference to FIG. 9.

Figure 6:
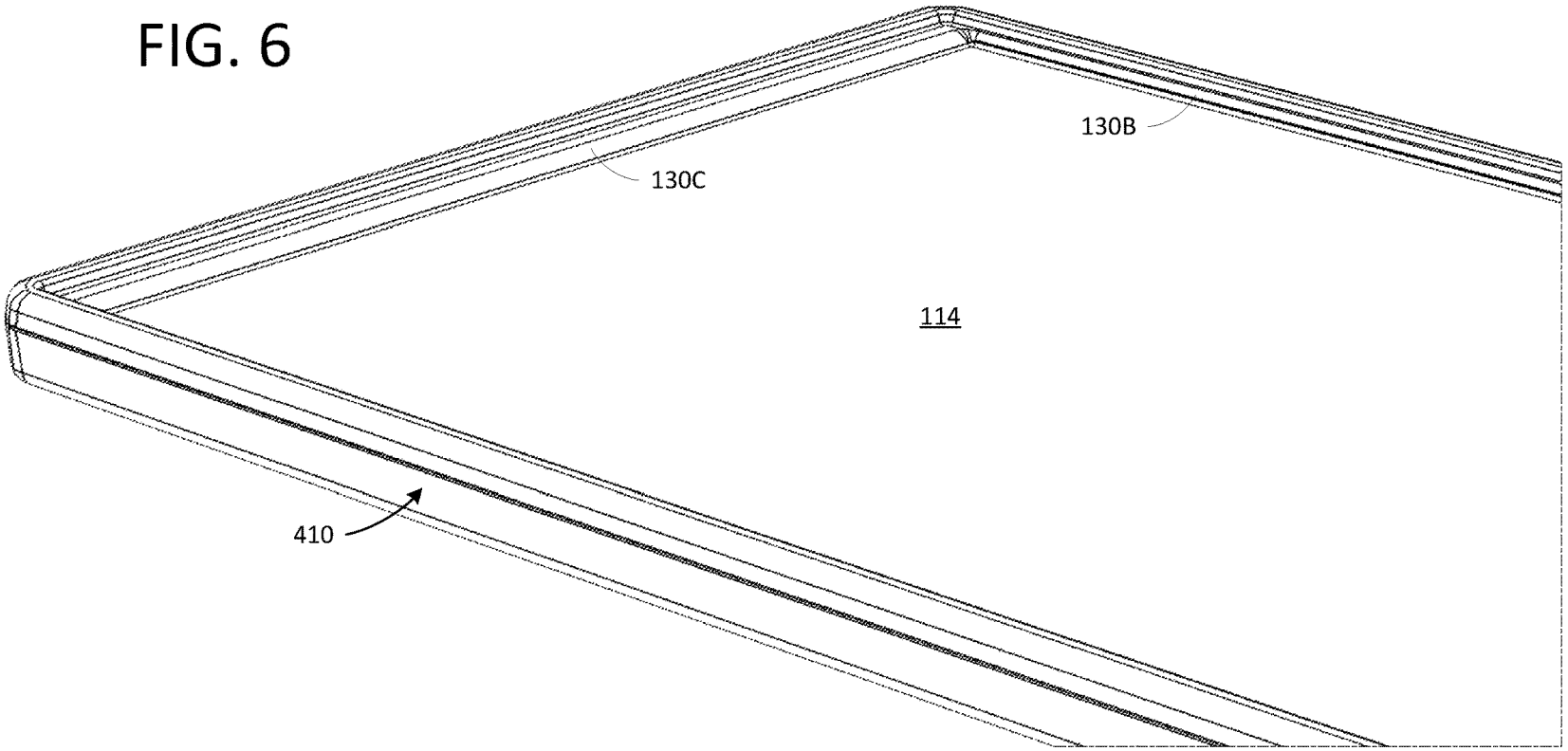
FIG. 6 illustrates a close perspective view showing detail of the lower left portion of the cover.

FIG. 6 illustrates a close perspective view showing detail of the lower left portion of the cover 104. Two steps 130B and 130C that form the left and lower side portions of the depressed cover platform 114 are visible.

Figure 7:
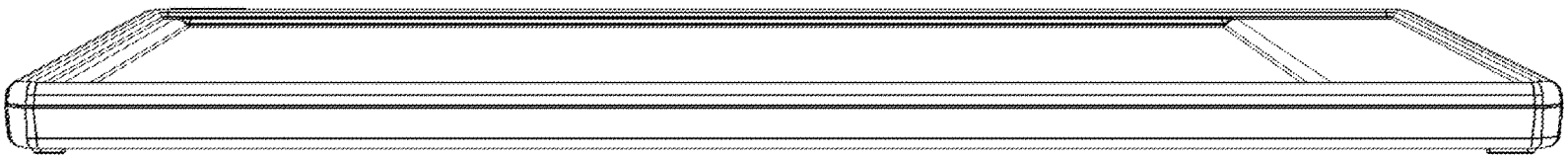
FIG. 7 illustrates a low perspective view of the assembled case from the right side.

FIG. 7 illustrates a low perspective view of the assembled case from the right side.

Figure 8:
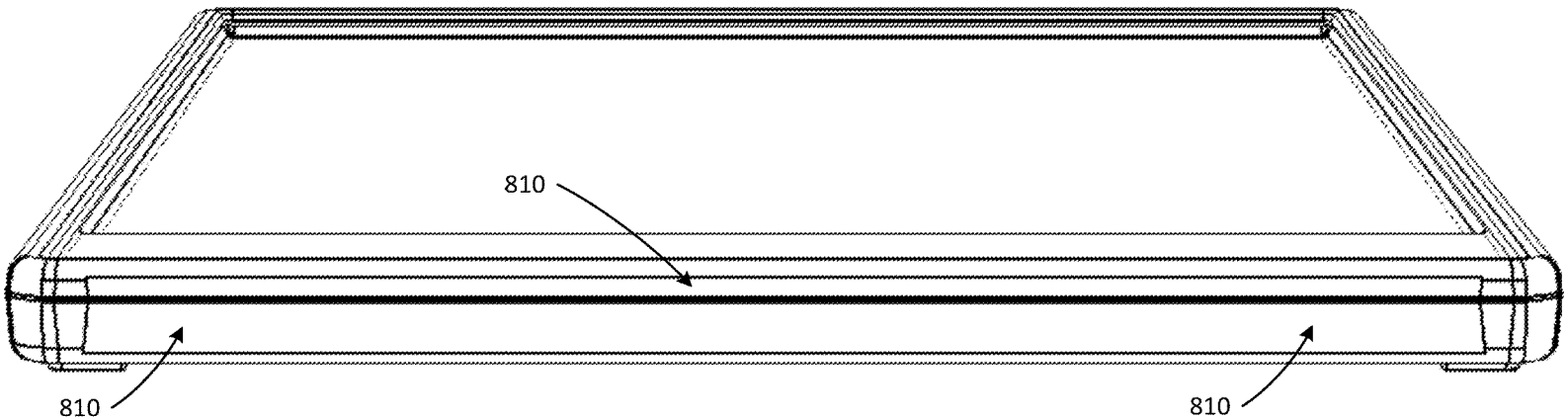
FIG. 8 illustrates a low perspective view of the assembled case from the top side.

FIG. 8 illustrates a low perspective view of the assembled case from the top side. In one embodiment, the case can include a window area 810 on the top side of the case through which the tab portion 204B of the certificate 204 can be viewed. The window area 810, as shown, can extend along outside of the top wall 210 between near the left and right sides of the case, and between near the bottom of the base 102, across the joint between the base 102 and the cover 104, to near the top of the cover 104. In certain embodiments, the window area 810 may not be visible or distinguishable from other areas of the case, for example, if the case is formed completely of clear transparent plastic and all of the outside portions of the case are polished.

Figure 9:
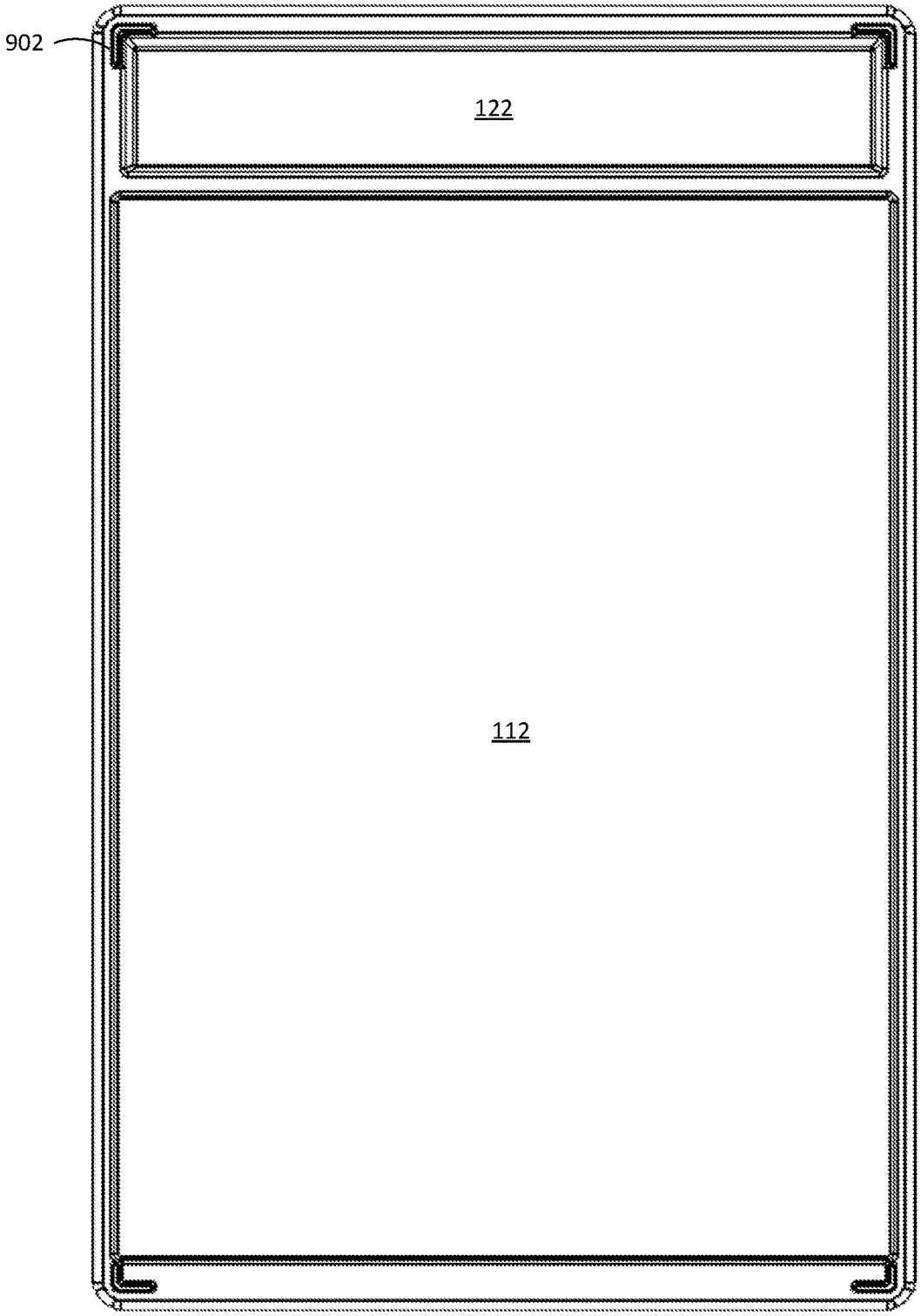
FIG. 9 illustrates a rear elevation view of the assembled case.

FIG. 9 illustrates a rear elevation view of the assembled case. The underside of the base platform 112 and the certificate platform 122 are shown. In one embodiment, the base 102 includes a foot 902 near each the corner to stabilize the case when it is placed on a surface. Four feet 902, one at each corner of the base 102, can be configured to be receivable within the four corner features 520 of the outer ridge 510 of a cover 104 of another case. The matching between the feet 902 and the corner features 520 facilitates stacking of multiple cases atop one another such that the cases are prevented from sliding relative to one another by the interlocking of the feet 902 and corner features 520.

Figure 10:
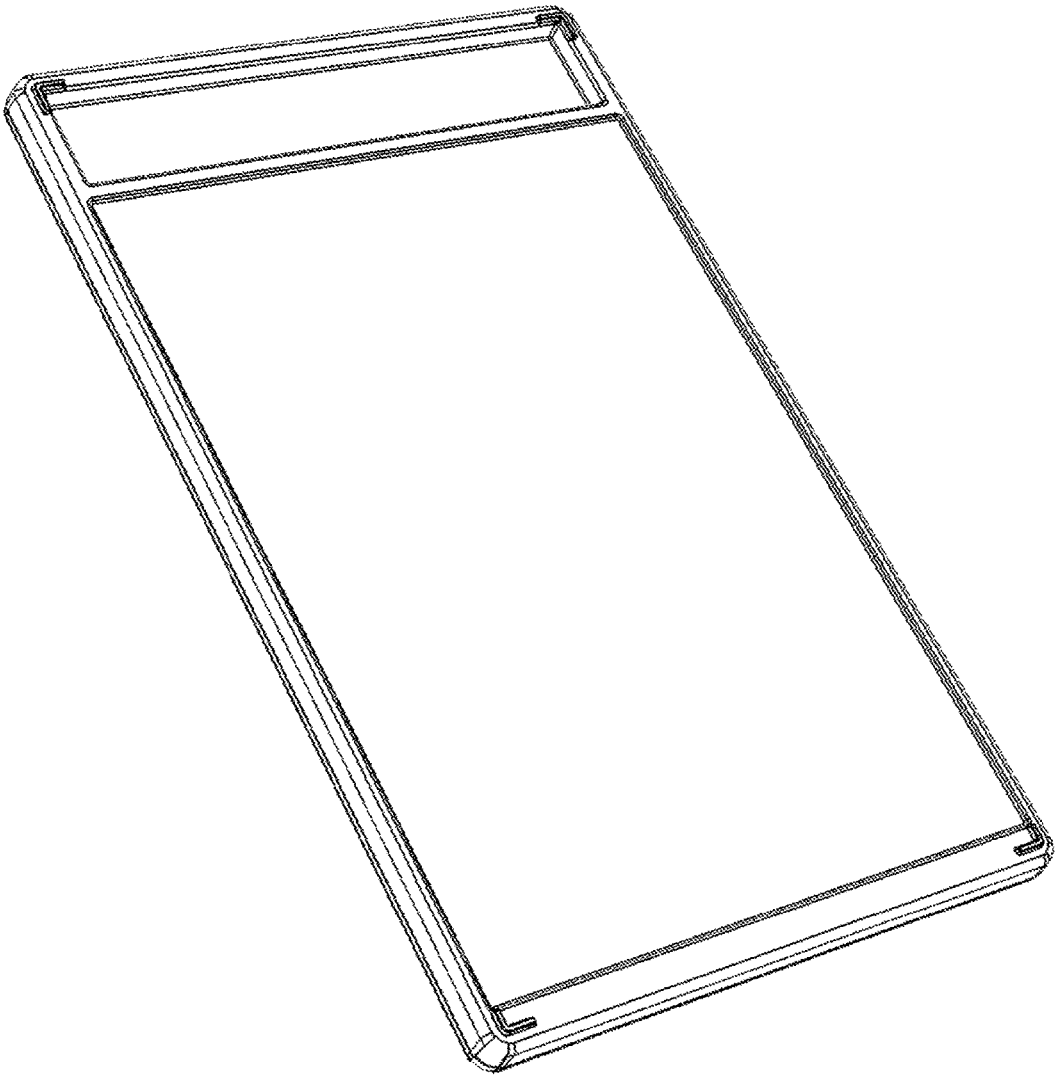
FIG. 10 illustrates a high side perspective view of the assembled case showing the base.
Figure 11:
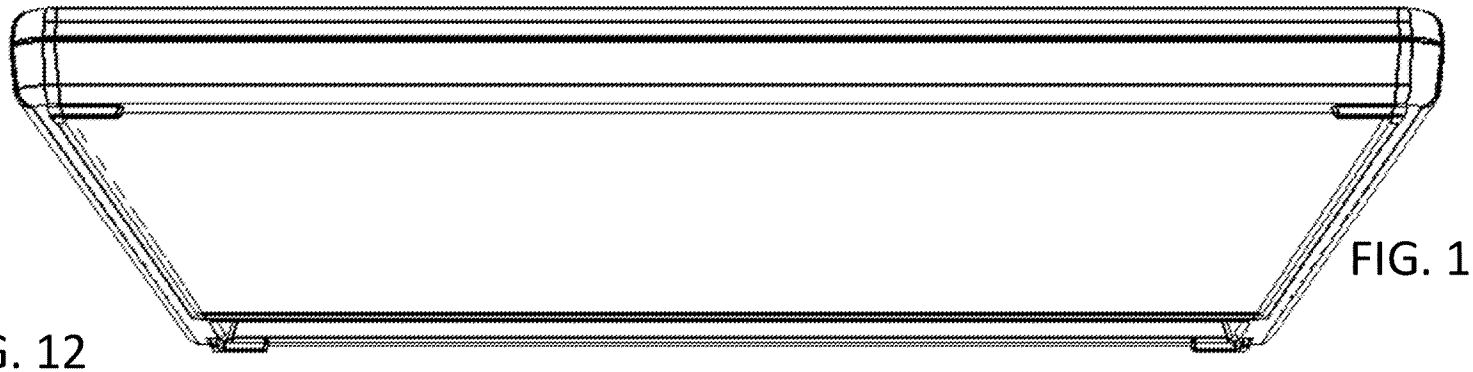
FIG. 11 illustrates a low perspective view of the assembled case showing the base from the bottom side.
Figure 12:
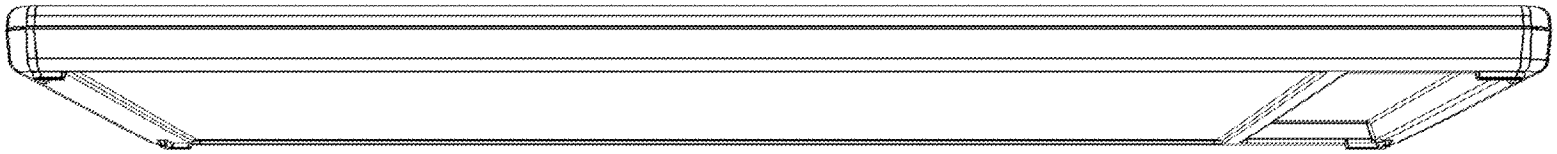
FIG. 12 illustrates a low perspective view of the assembled case showing the base from the side.
Figure 13:
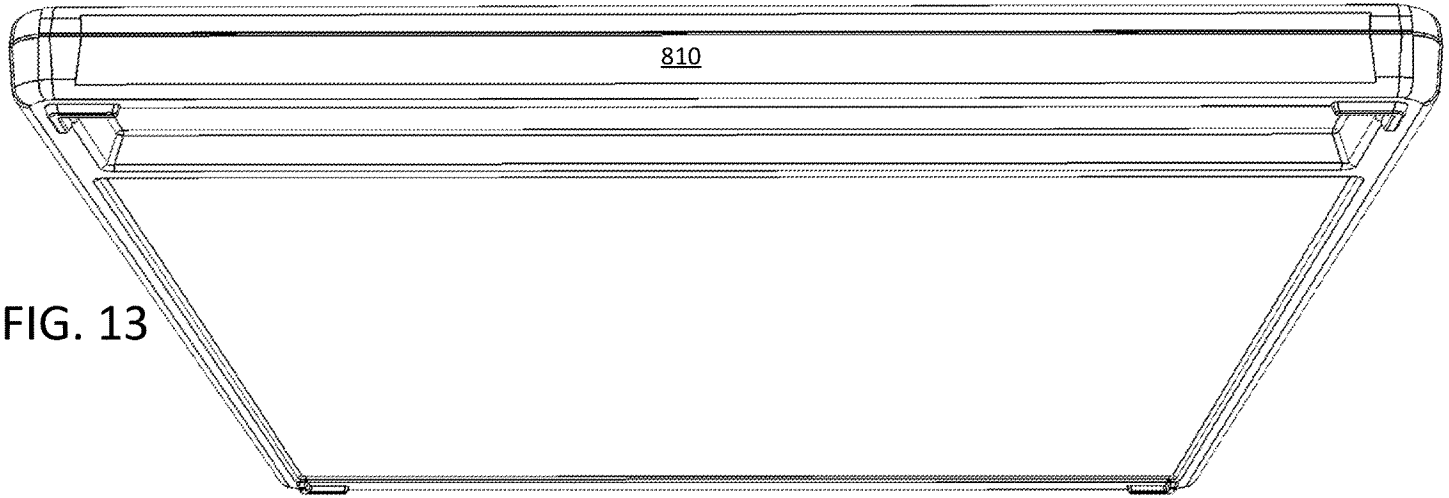
FIG. 13 illustrates a low perspective view of the assembled case showing the base from the top side.

FIG. 10 illustrates a high side perspective view of the assembled case showing the base 102. FIG. 11 illustrates a low perspective view of the assembled case showing the base 102 from the bottom side. FIG. 12 illustrates a low perspective view of the assembled case showing the base 102 from the side. FIG. 13 illustrates a low perspective view of the assembled case showing the base 102 from the top side.

Figure 14A:
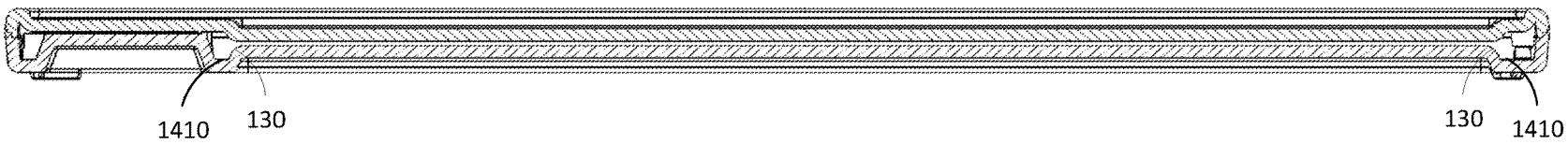
FIG. 14A illustrates an embodiment of a case configured with an approximately 1 mm gap between the upper surface of the base platform and the lower surface of the cover platform.
Figure 14B:
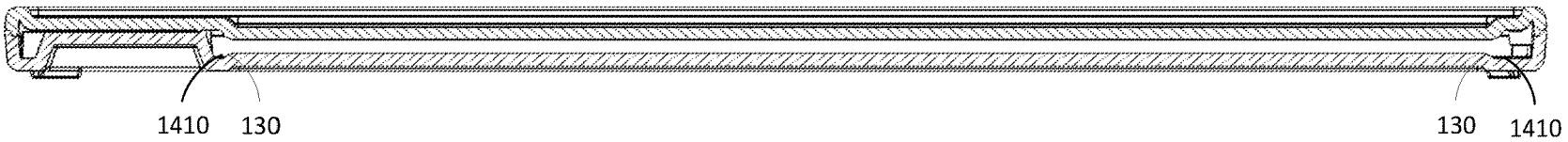
FIG. 14B illustrates an embodiment of a case configured with an approximately 3 mm gap between the upper surface of the base platform and the lower surface of the cover platform (this embodiment is also shown in all other figures) .
Figure 14C:
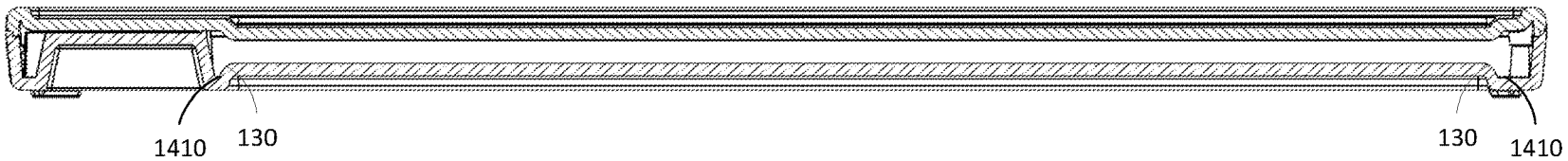
FIG. 14C illustrates an embodiment of a case configured with an approximately 5 mm gap between the upper surface of the base platform and the lower surface of the cover platform.

FIGS. 14A-C illustrate three different embodiments of the case configured to accommodate different size comic books. The FIGS. 14A-C each show a cut-away elevation taken along the top-bottom centerline of the assembled case. FIG. 14A illustrates an embodiment of a case configured with an approximately 1 mm gap between the upper surface of the base platform 112 and the lower surface of the cover platform 114. FIG. 14B illustrates an embodiment of a case configured with an approximately 3 mm gap between the upper surface of the base platform 112 and the lower surface of the cover platform 114 (this embodiment is also shown in all other figures). FIG. 14C illustrates an embodiment of a case configured with an approximately 5 mm gap between the upper surface of the base platform 112 and the lower surface of the cover platform 114. The same cover 104 can be used in each of the 1 mm, 3 mm, and 5 mm embodiments in conjunction with different bases 104.

FIGS. 14A-C also show steps 130 that define the base platform 112 relative to a bottom portion 1410 of the base 104. The bases 104 of the 1 mm and 3 mm embodiments can be configured with the same outer dimensions to produce assembled cases with the same outer dimensions. In the case of the 1 mm case, the base platform 112 is raised higher above the surrounding portions of the base 102 by using a larger step 130 to form the base platform 112. The base 104 of the 5 mm case of FIG. 14C has a thicker overall dimension resulting in a thicker case overall relative to the assembled 1 mm and 3 mm cases to accommodate a larger book while still incorporating a step 130 to form the base platform 112. Different embodiments can be configured to accommodate still different thickness books. Additional embodiments of the case can also be configured to accommodate books of different heights and widths in addition to different thicknesses.

Figure 15:
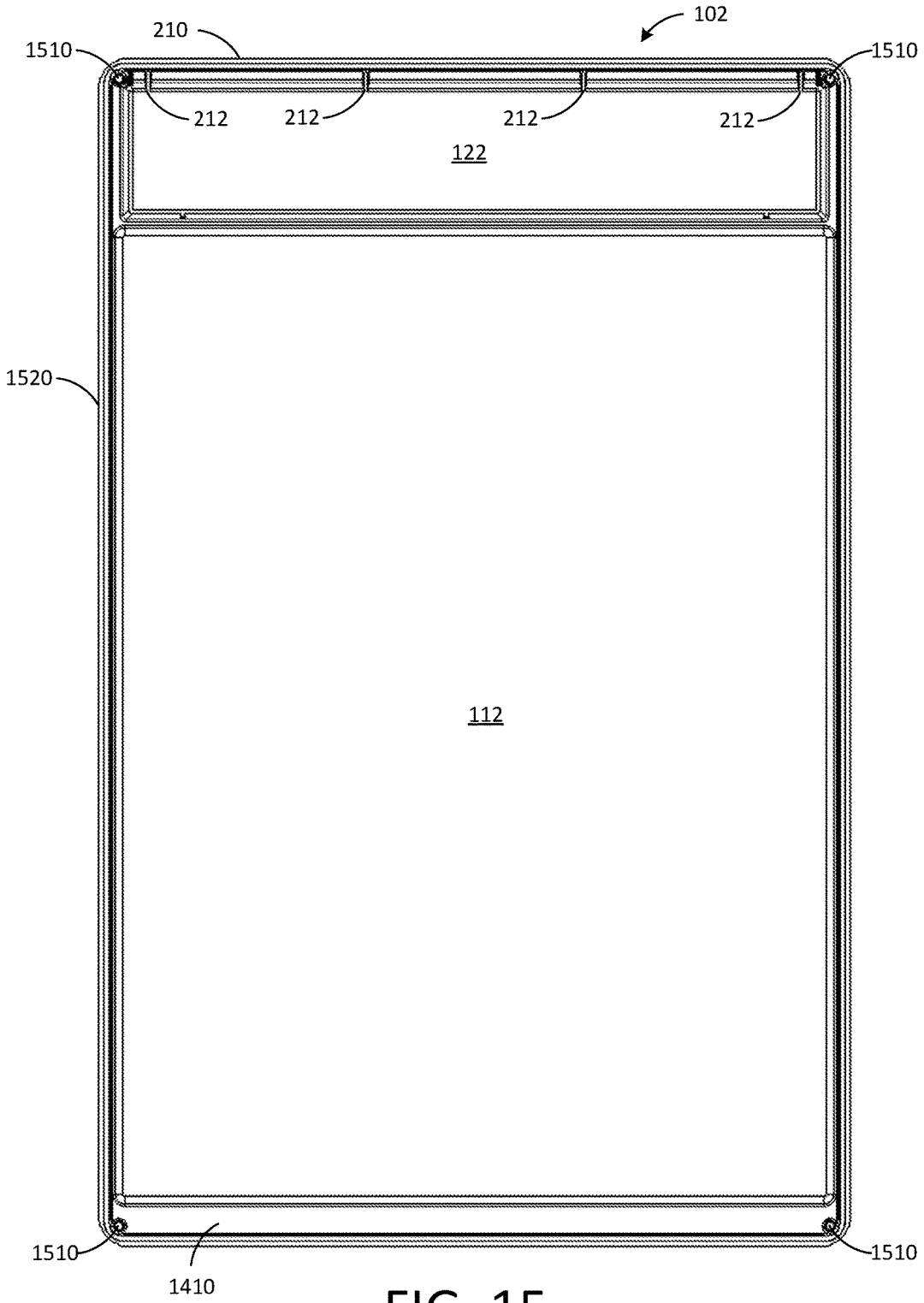
FIG. 15 illustrates an elevation view of the inside of the base.
Figure 16A:
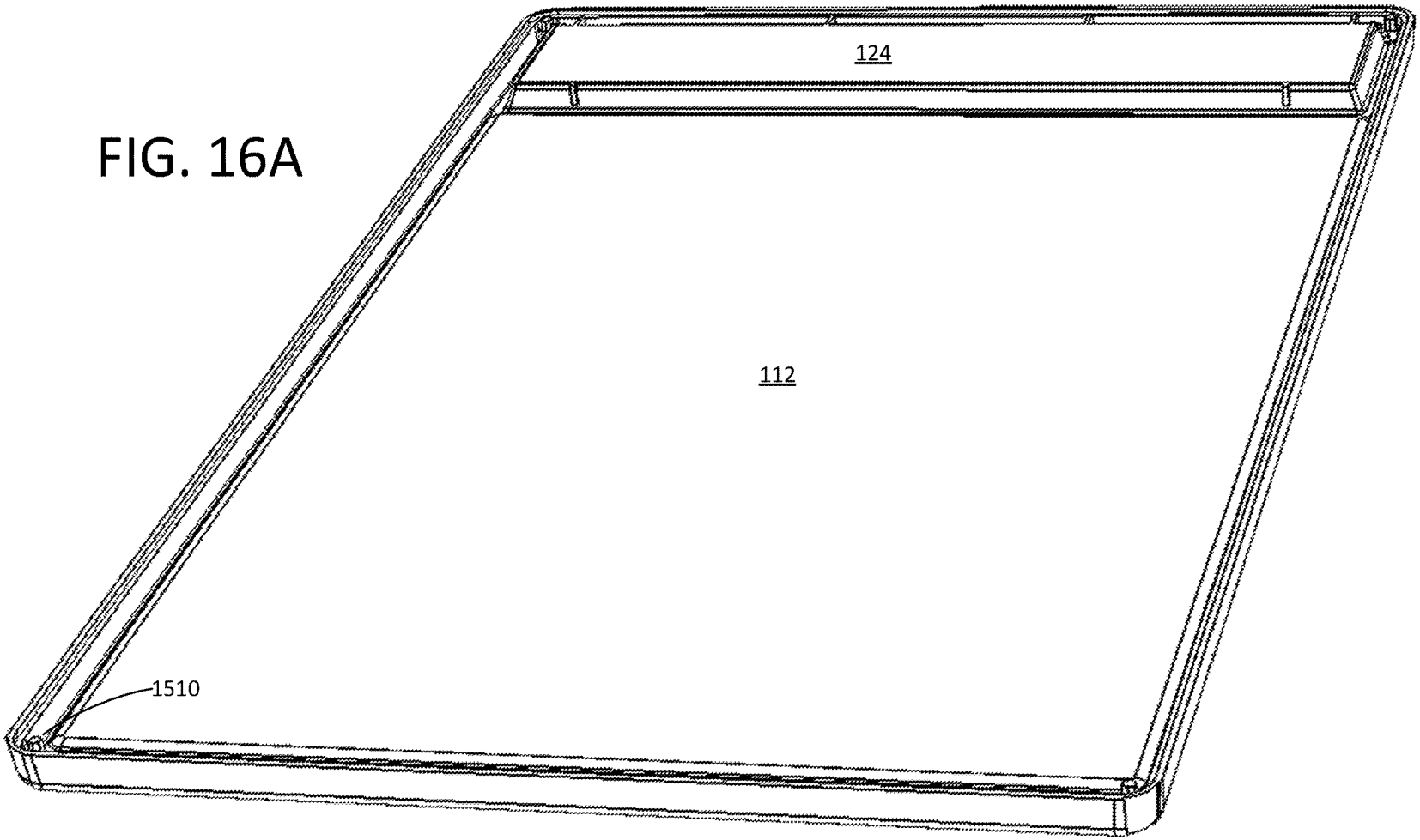
FIG. 16A illustrates a perspective view of the inside of the base from the lower right side.
Figure 16B:
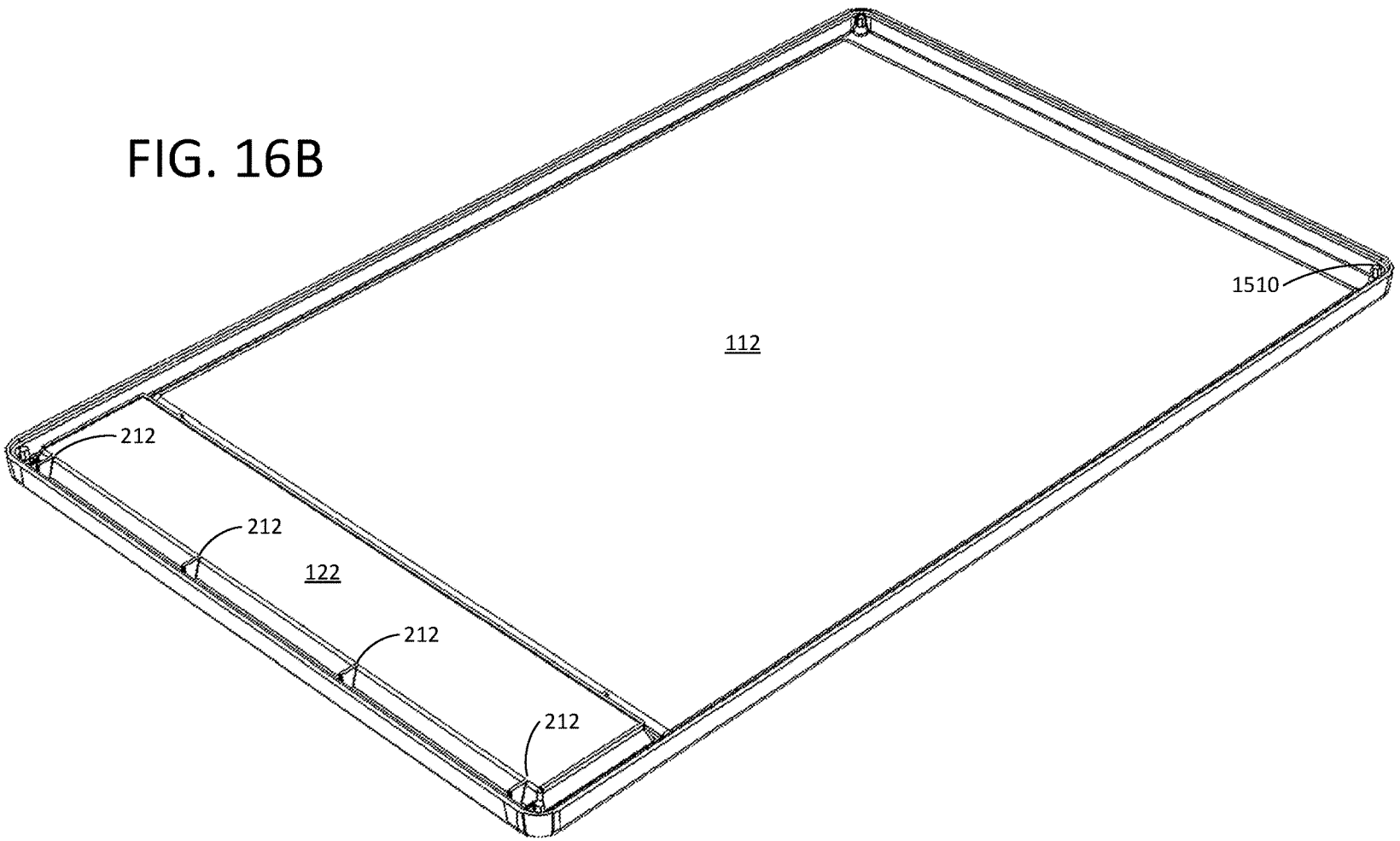
FIG. 16B illustrates a perspective view of the inside of the base from the upper left side.

FIG. 15 illustrates an elevation view of the inside of the base 102. FIG. 16A illustrates a perspective view of the inside of the base 102 from the lower right side. FIG. 16B illustrates a perspective view of the inside of the base 102 from the upper left side. FIGS. 15, 16A and 16B show the base platform 112 as well as the certificate platform 122. FIGS. 15 and 16B also show four vertically aligned fins 212 that extend outward from the certificate platform 122 leaving the slot 230 between the top wall 210 into which the tab portion 204B of the certificate 204 fits. The slot 230 is more clearly shown in FIG. 18, discussed below. FIG. 15 also shows the two side walls 310 and the bottom wall 320.

Figure 19:
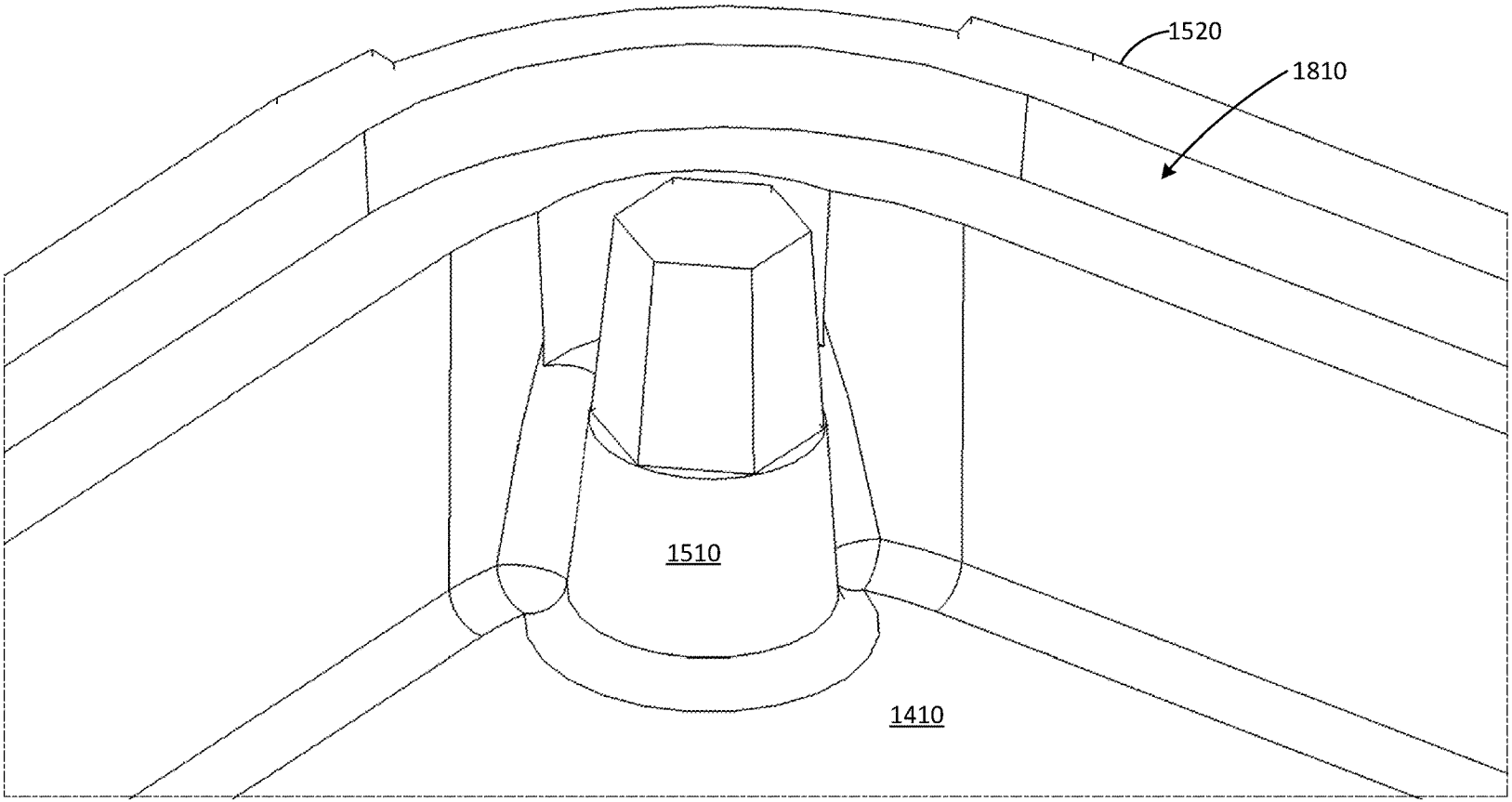
FIG. 19 illustrates a close up perspective view of a lower corner portion of the inside of the base.

FIGS. 15, 16A and 16B also show a post 1510 in each corner of the base 102. The four posts 1510, which will be described in greater detail below with reference to FIG. 19, are configured to be received in receptacles 2010 (shown and discussed below with reference to FIGS. 20-22) in the cover 104 to temporarily hold the assembled case together before the case is permanently closed using ultrasonic bonding. FIG. 15 also shows the base portion of the outer wall 410 that includes the top wall 210, the side walls 310 and the bottom wall 320.

Figure 17:
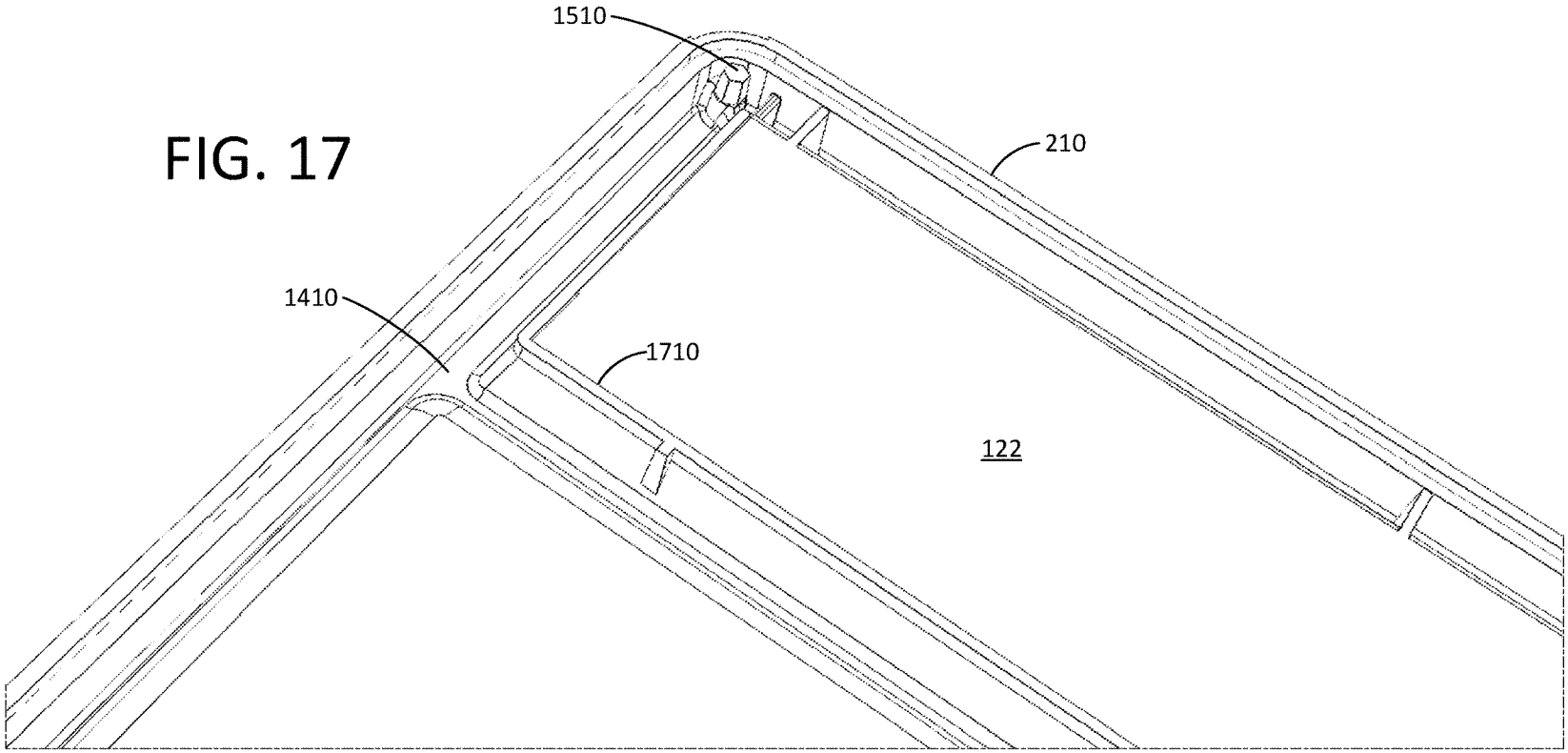
FIG. 17 illustrates a close up perspective view of the upper left hand section of the inside of the base.

FIG. 17 illustrates a close up perspective view of the upper left hand section of the inside of the base 102. One of the posts 1510 is shown extending upward from a bottom portion 1410 of the base 102. The certificate platform 122 includes a ridge 1710 that extends around three sides and upward from the upper surface of the certificate platform 122. The ridge 1710 serves to fix the certificate 204 in place so that it does not become dislodged laterally. The ridge 1710 can optionally be configured to extend along two, three, or all sides of the perimeter of the certificate platform 122 in different embodiments.

Figure 18:
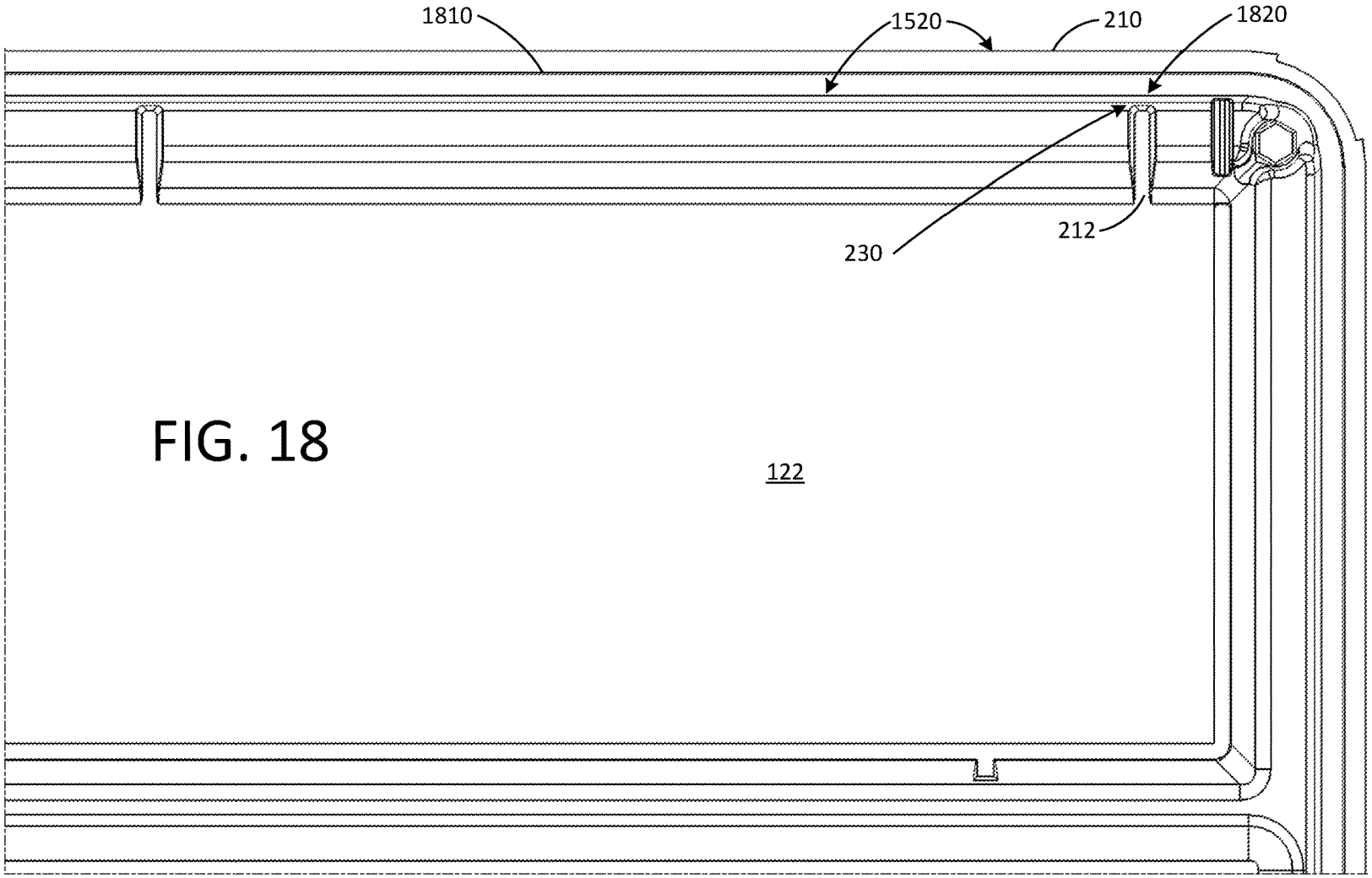
FIG. 18 illustrates a close up plan view of the upper right portion of the base.

FIG. 18 illustrates a close up plan view of the upper right portion of the base. The close up more clearly shows the thickness of the outer wall 410 of the case as well as a step 1810 that runs roughly along the center of the outer wall 410. The step 1810 mirrors a matching inverse step in the perimeter of the cover such that the two steps fit together to align the base 102 and cover 104 upon assembly. The step 1810 is shown more clearly in FIG. 19 and the cross sections of FIGS. 14A-C and FIGS. 24A-G. The close up of FIG. 18 also more clearly shows the slot 230 between the inner surface 1820 of the top wall 210 and the fins 212.

FIG. 19 illustrates a close up perspective view of a lower corner portion of the inside of the base 102. This perspective view more clearly shows the geometry of one of the posts 1510 as well as the step 1810. The post 1510 extends upwards from a bottom portion 1410 of the base. In one embodiment, each post has a hexagonally shaped top section that is configured for a snug fit into a boss or receptacle 2010 (shown and discussed below with reference to FIGS. 20-22). The post 1510 is preferably tapered such that as it is inserted into the receptacle 2010, the edges of the hexagonal shape impinge upon the walls of the receptacle so as to hold the base 102 and cover 104 together. Although a hexagonal shape is shown, other shapes can be used, such as a cylinder or other polygonal shapes.

Figure 20:
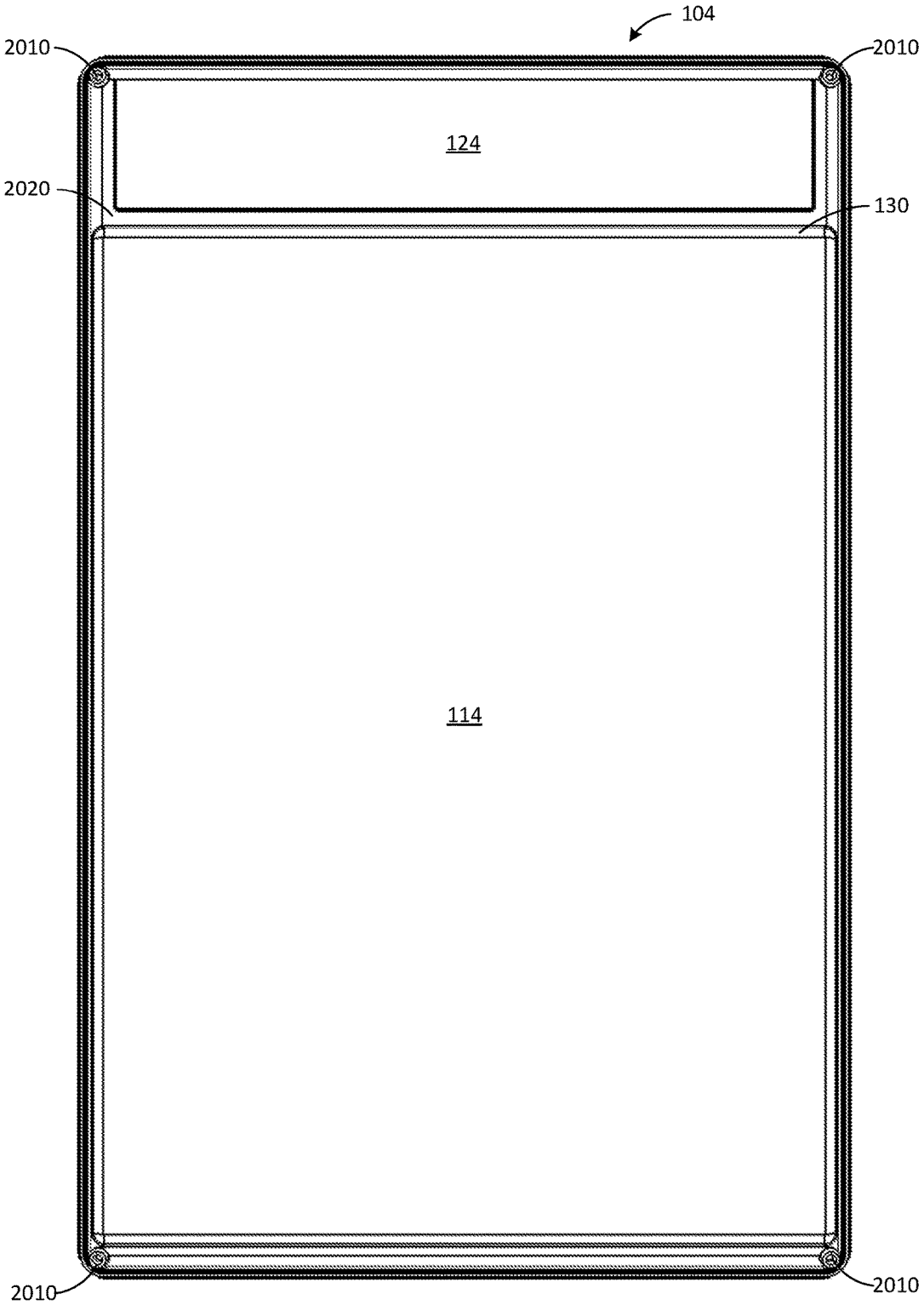
FIG. 20 illustrates an elevation view of the inside of the cover.
Figure 21A:
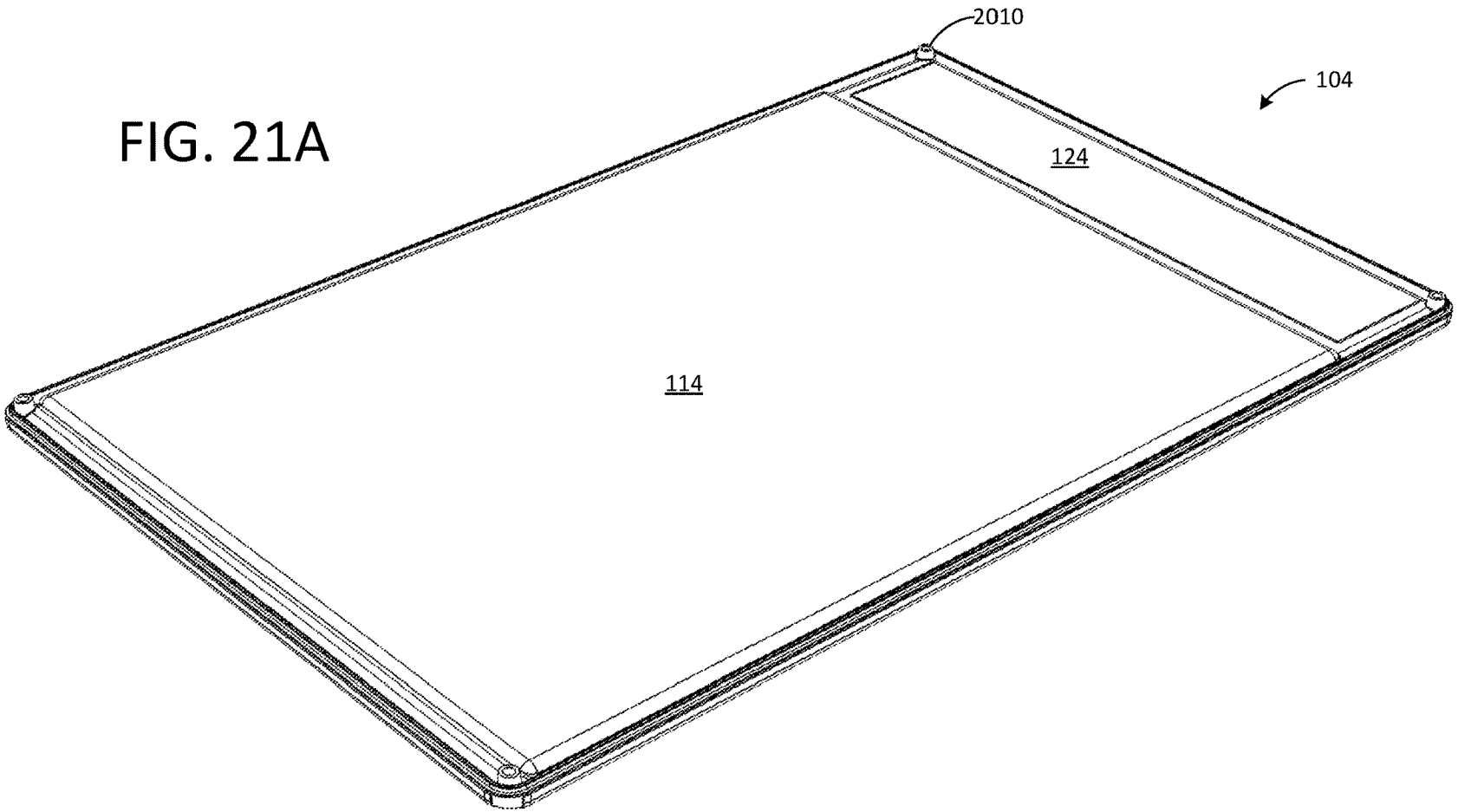
FIG. 21A illustrates a perspective view of the inside of the cover from the lower right side.
Figure 21B:
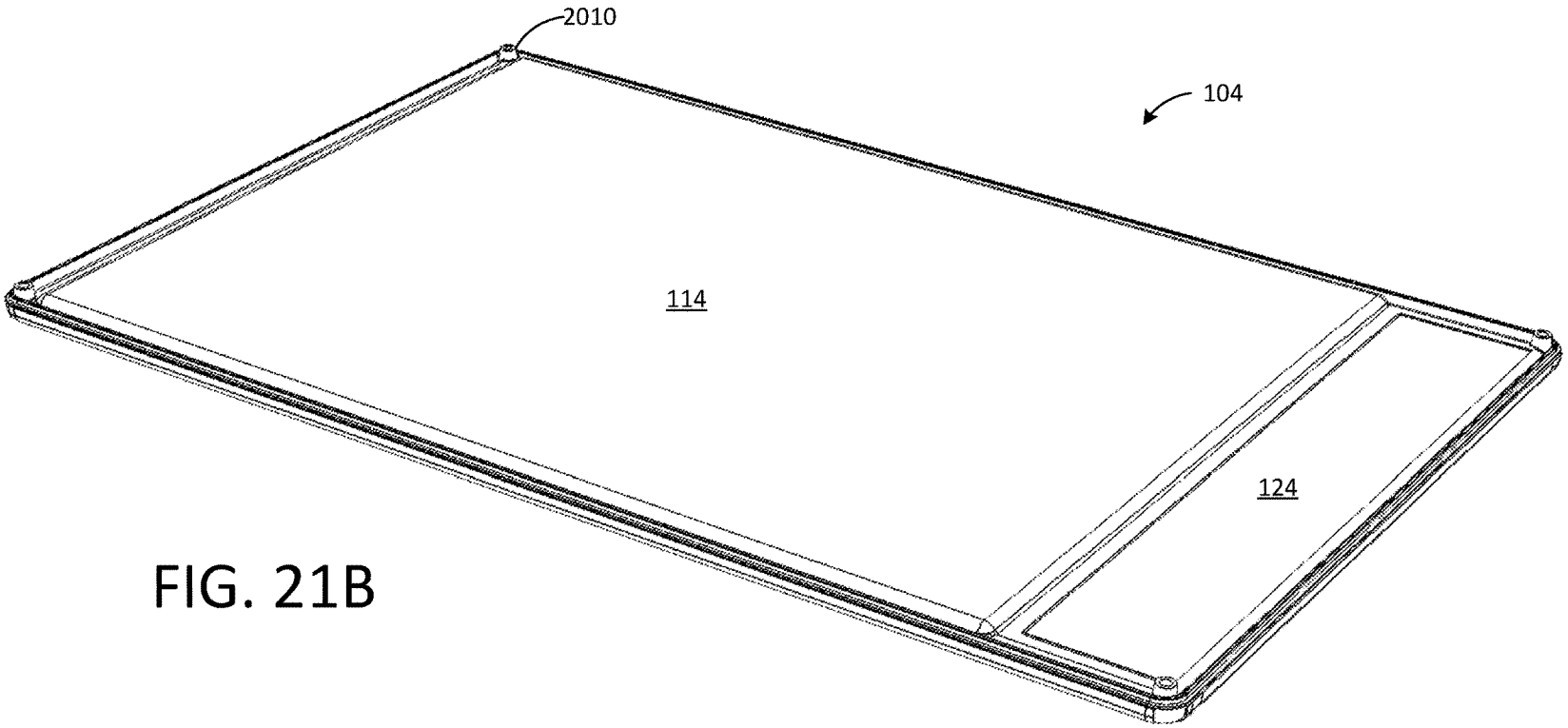
FIG. 21B illustrates a perspective view of the inside of the cover from the upper right side.

FIG. 20 illustrates an elevation view of the inside of the cover 104. FIG. 21A illustrates a perspective view of the inside of the cover 104 from the lower right side. FIG. 21B illustrates a perspective view of the inside of the cover 104 from the upper right side. FIGS. 20, 21A and 21B show the depressed cover platform 114 as well as the certificate window 124. FIGS. 20, 21A and 21B also show a receptacle 2010 for each post 1510 in each corner of the cover 104.

FIG. 20 also shows an upper portion 2020 of the cover 104 relative to which the cover platform 114 is depressed (from the perspective of an assembled case) by way of steps 130.

Figure 22:
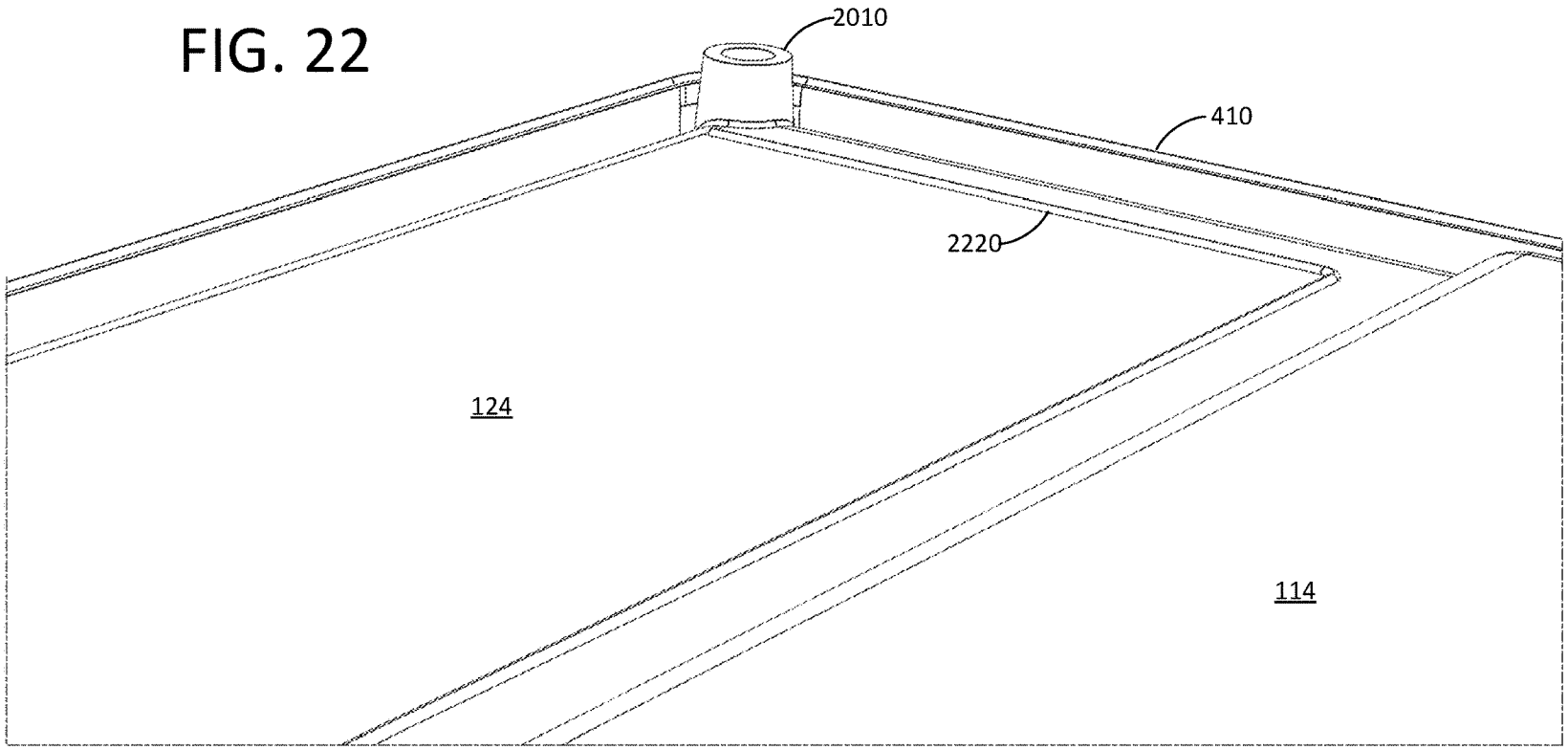
FIG. 22 illustrates a close up perspective view of the upper right hand section of the inside of the base.

FIG. 22 illustrates a close up perspective view of the upper right hand section of the inside of the cover 104. One of the receptacles 2010 is shown extending upward from a bottom (relative to the view) of the cover 104. The certificate window 124 includes a ridge 2220 that protrudes from the inner surface of the certificate window 124 to match the ridge 1710 of the certificate platform 122. The ridge 1710 of the certificate platform 122 and the ridge 2220 of the certificate window 124 preferably meet or interlock when the case is assembled to fix the certificate 204 in place so that it does not become dislodged laterally. The ridge 2220 can optionally be configured to extend along two, three, or all sides of the perimeter of the certificate window 124 in different embodiments. FIG. 22 also shows a portion of the outer wall 410 of the cover 104 that interlocks with a portion of the outer wall 410 of the base 102.

Figure 23:
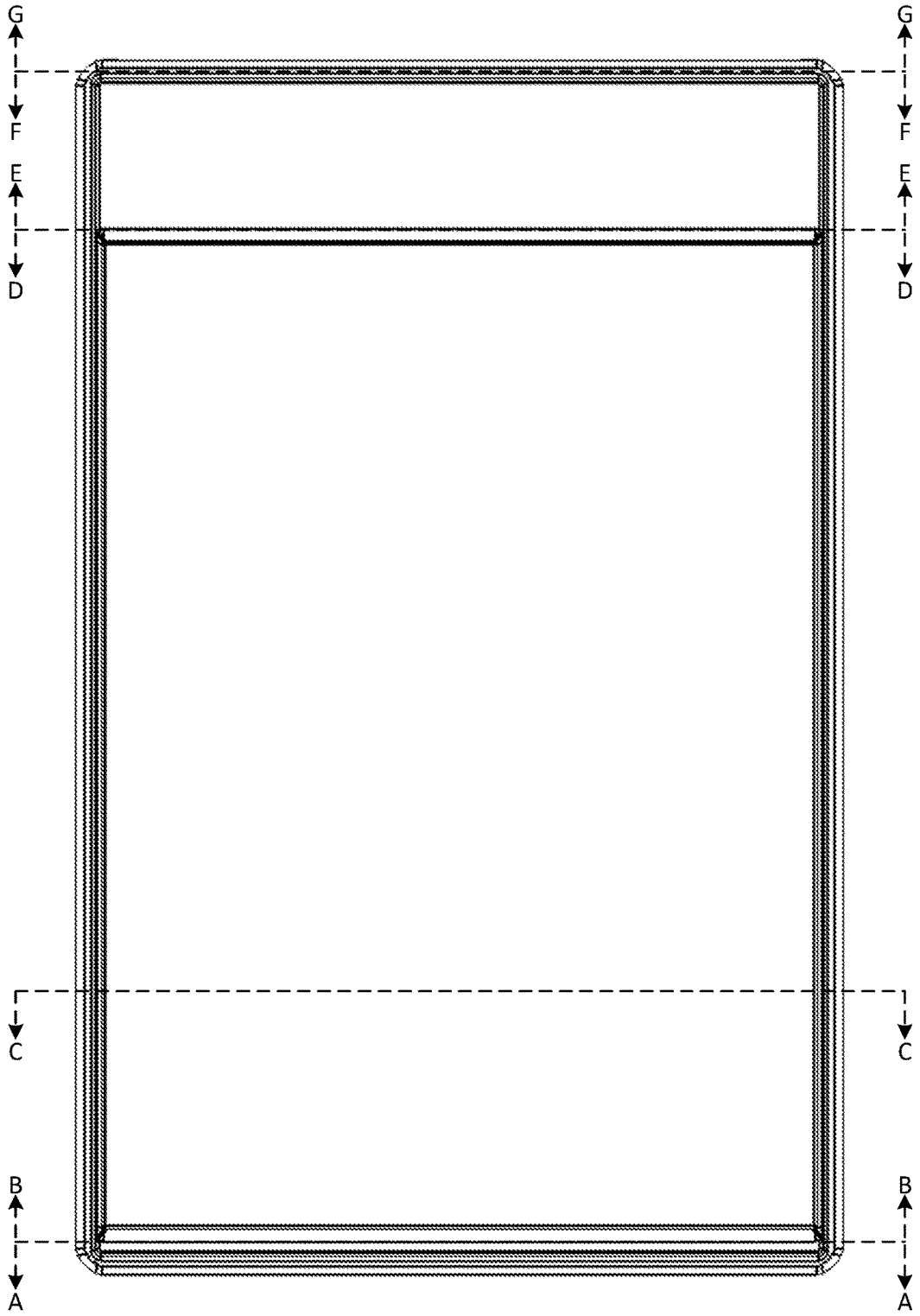
FIG. 23 illustrates the same elevational view of the assembled case as FIG. 3, but with sight lines added that indicate the locations of cross section and cut-away views shown in FIGS. 24A-G.

FIG. 23 illustrates the same elevational view of the assembled case as FIG. 3, but with sight lines added that indicate the locations of cross section and cut-away views shown in FIGS. 24A-G. Each sight line A-G in FIG. 23 corresponds to an associated FIG. 24A-G.

Figure 24A:
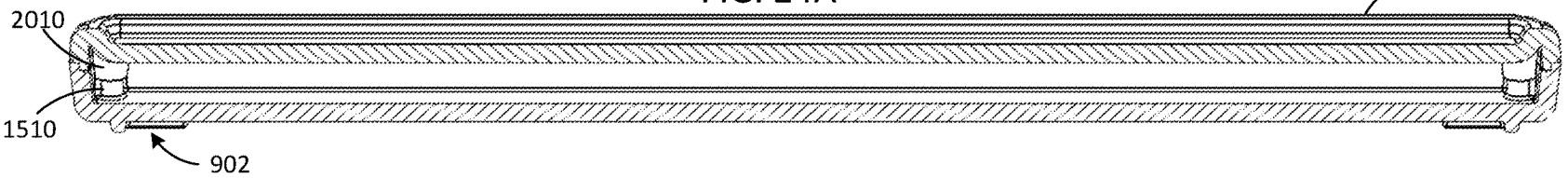
FIG. 24A illustrates a perspective view of a cut away through the case along sight line A.

FIG. 24A illustrates a perspective view of a cut away through the case along sight line A. A post 1510 is shown interlocking with a receptacle 2010. The feet 902 and the outer ridge 510 of the cover 104 are also shown.

Figure 24B:
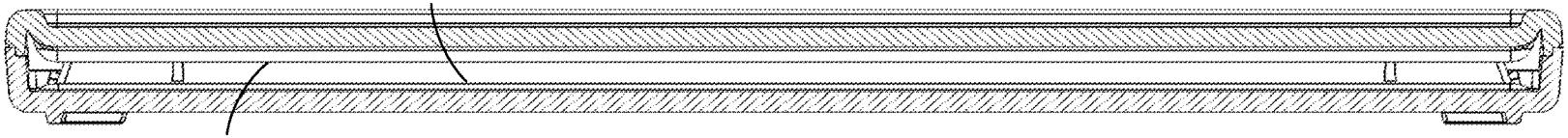
FIG. 24B illustrates a sectional elevation view through the case along sight line B.

FIG. 24B illustrates a sectional elevation view through the case along sight line B. The sectional view is taken through the bottom step 130 of the cover platform 114. The base platform 112 and cover platform 114 are shown.

Figure 24C:
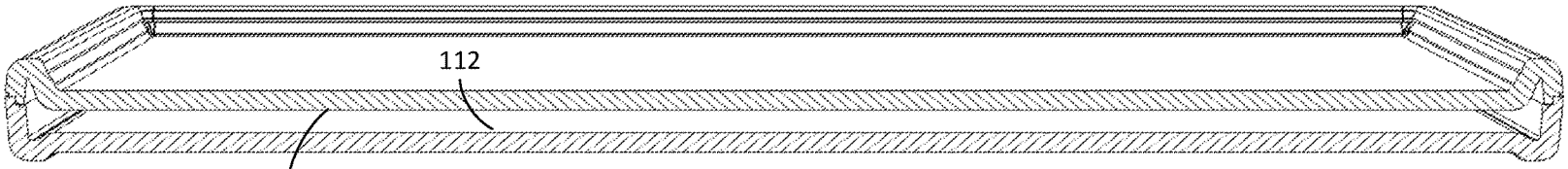
FIG. 24C illustrates a perspective view of a cut away through the case along sight line C.

FIG. 24C illustrates a perspective view of a cut away through the case along sight line C. The base platform 112 and cover platform 114 are shown bounding a space within which a book is held by the case.

Figure 24D:
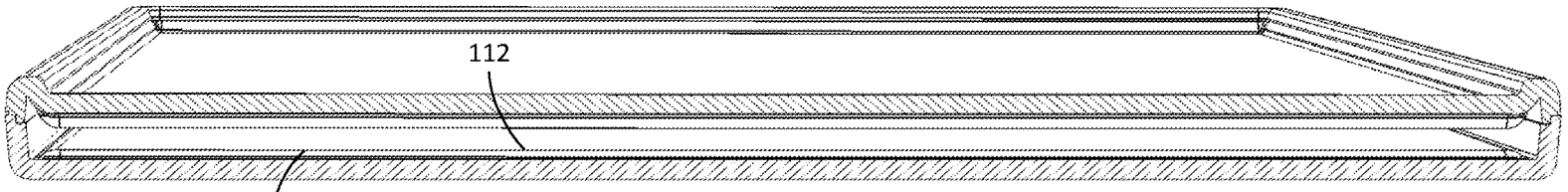
FIG. 24D illustrates a perspective view of a cut away through the case along sight line D.

FIG. 24D illustrates a perspective view of a cut away through the case along sight line D. The sectional view is taken through a step 130 of the cover platform 114 between the cover platform and the certificate window 124. The base platform 112 and cover platform 114 are shown.

Figure 24E:
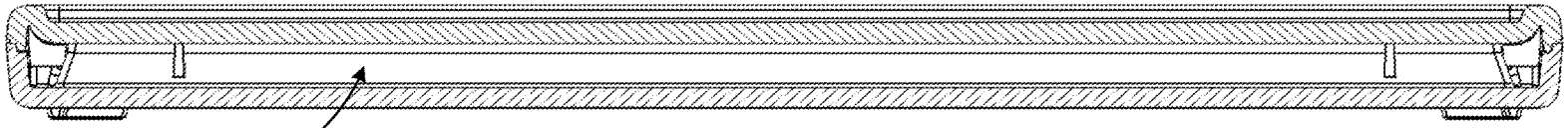
FIG. 24E illustrates a sectional elevation view through the case along sight line E.

FIG. 24E illustrates a sectional elevation view through the case along sight line E. The sectional view is taken through a step 130 of the cover platform 114 between the cover platform and the certificate window 124. The certificate platform 122 is shown.

Figure 24F:
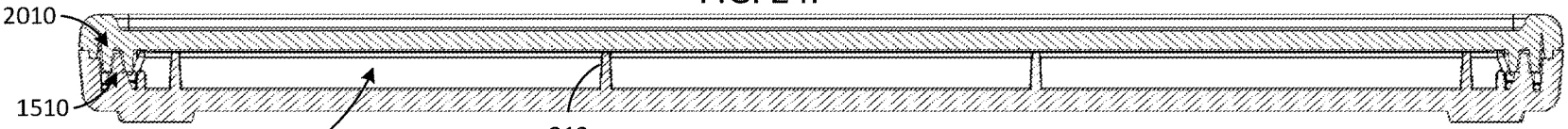
FIG. 24F illustrates a sectional elevation view through the case along sight line F.

FIG. 24F illustrates a sectional elevation view through the case along sight line F. A post 1510 is shown interlocking with a receptacle 2010. The fins 212 that hold the tab portion 204B of the certificate 204 in place are also shown. The certificate platform 122 is shown.

Figure 24G:
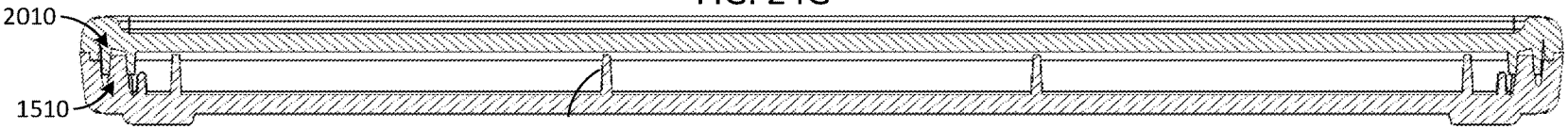
FIG. 24G illustrates a sectional elevation view through the case along sight line G.

FIG. 24G illustrates a sectional elevation view through the case along sight line G. A post 1510 is shown interlocking with a receptacle 2010. The fins 212 that hold the tab portion 204B of the certificate 204 in place are also shown.

Referring again to FIG. 2, before being encapsulated in the case, a book 202 is optionally first placed in a clear plastic envelope or bag. The envelope can be, for example, a clear archival film envelope made of polyethylene terephthalate or Mylar. The envelope can be sealed on three sides and left open on one end, or a fourth side can be closed using a fold over tab on the envelope.

In order to assemble the case, the optionally enveloped book is placed on the base platform 112 and a scored and folded certificate 204 is placed on the certificate platform 122 with the tab portion 204B extending down between the fins 212 and the top wall 210 of the base 102. The cover 104 of the case is then fitted over the book 202 and certificate 204 and depressed such that the posts 1510 and receptacles 2010 engage to provide a temporary fixing of the assembly. The temporarily assembled case is then placed in an ultrasonic bonding machine, which is then activated to bond the base 102 to the cover 104. The base and cover can be designed using known techniques such that ultrasonic bonding occurs along parts or all of the perimeters of the base and cover. In one embodiment, the bonding occurs along the sides of the perimeter of the case but not along the top and bottom of the perimeter of the case.

In addition or in the alternative to ultrasonic bonding around the perimeter, ultrasonic bonding can be configured to occur within or on the mating junctions of the posts and receptacles. By using ultrasonic bonding on the posts and receptacles, the posts and receptacles can be used as a visual indication of tampering with the assembled case. In some embodiments the number of posts and receptacles can be increased or decreased and any appropriate number of posts/receptacles can be spaced around the perimeter of the case to provide a semi-permanent bond between the base 102 and the cover 104. The ultrasonic bond around the perimeter can be omitted so as to allow the case to be more easily disassembled in case a user wants access to the book inside. The breaking of the bonds between the posts and receptacles or the breaking of the posts/receptacles themselves, however, will provide a visual indication that the case has been opened.

Although the invention has been described in terms of certain embodiments, other embodiments that will be apparent to those of ordinary skill in the art, including embodiments which do not provide all of the features and advantages set forth herein, are also within the scope of this invention. Accordingly, the scope of the invention is defined by the claims that follow. It should be understood that the subject matter defined in the appended claims is not necessarily limited to the specific implementations described above. The specific implementations described above are disclosed as examples only.

The invention claimed is:

1. A case for a book and a certificate, the case comprising:

a base for supporting the book, the base comprising a raised certificate platform for supporting the certificate, the certificate platform comprising an upper surface and bounding steps on at least two sides that form a step down from the upper surface to an adjacent bottom portion of the base, the raised certificate platform comprising at least one feature configured to prevent lateral movement of the certificate; and a cover that engages with and covers the base to retain the book and the certificate between the cover and the base, wherein the base and the cover include transparent portions through which at least a front and back of the book can be viewed from outside the case.

2. The case of claim 1, wherein the at least one feature comprises a ridge that projects upward from the upper surface of the certificate platform and extends along a portion of at least one side of a perimeter the certificate platform.

3. The case of claim 1, wherein the base further comprises a raised base platform on which the book is supported, the raised base platform being defined by an upper surface and bounding steps on at least two sides that form a step down from the upper surface to a bottom portion of the base.

4. The case of claim 1, wherein the cover comprises a depressed inverted cover platform defined by a lower surface and bounding steps on at least two sides that form a step up from the lower surface to an upper portion of the cover.

5. The case of claim 1, wherein the cover further comprises a certificate window configured to secure the certificate upon the certificate platform and through which the certificate can be viewed.

6. The case of claim 5, wherein the certificate window comprises a ridge that extends along two or more sides of a perimeter of the certificate window, the ridge configured to fix the certificate in place.

7. The case of claim 1, wherein the base, the cover or both the base and the cover comprise an outer wall disposed substantially perpendicular to the certificate platform and connecting the base to the cover.

8. The case of claim 7, further comprising the certificate, wherein the certificate comprises a face portion disposed on the certificate platform and a folded tab portion that can be viewed from outside the case through the outer wall.

9. The case of claim 8, wherein the tab portion of the certificate is formed by scoring the certificate and folding the certificate along the score.

10. The case of claim 8, further comprising a plurality of fins disposed substantially perpendicular to the outer wall and forming a gap between the fins and an inner surface of the outer wall, wherein the gap is configured to receive the tab portion of the certificate.

11. The case of claim 7, further comprising a plurality of fins disposed substantially perpendicular to the outer wall and forming a gap between the fins and an inner surface of the outer wall, wherein the gap is configured to receive a label that can be viewed from outside the case through the outer wall.

12. The case of claim 1, further comprising a comic book disposed between the base and the cover and a certificate disposed on the certificate platform, wherein the base is ultrasonically bonded to the cover to encapsulate the comic book and the certificate.

13. A case for a book, the case comprising:

a certificate comprising a face portion and a folded tab portion disposed substantially perpendicular to the face portion;

a base for supporting the book and the certificate; and a cover that engages with and covers the base to retain the book and the certificate between the cover and the base, wherein the base, the cover or both the base and the cover comprise an outer wall disposed substantially perpendicular to the certificate platform and connecting the base to the cover, wherein the base and the cover together include transparent portions through which at least a front of the book, a back of the book, the face portion of the certificate, and the tab portion of the certificate can be viewed from outside the case, and wherein the folded tab portion of the certificate is disposed substantially parallel to the outer wall.

14. The case of claim 13, wherein the tab portion of the certificate is formed by scoring the certificate and folding the certificate along the score.

15. The case of claim 13, further comprising a plurality of fins disposed substantially perpendicular to the outer wall and forming a gap between the fins and an inner surface of the outer wall, wherein the gap is configured to receive the tab portion of the certificate.

16. The case of claim 13, wherein the base comprises a raised certificate platform for supporting the certificate, the certificate platform comprising an upper surface and bounding steps on at least two sides that form a step down from the upper surface to a bottom portion of the base, the raised certificate platform comprising at least one feature configured to prevent lateral movement of the certificate, wherein the face portion of the certificate is disposed on the upper surface of the certificate platform.

17. The case of claim 16, wherein the at least one feature comprises a ridge that projects upward from the upper surface of the certificate platform and extends along a portion of at least one side of a perimeter the certificate platform.

18. The case of claim 13, wherein the base further comprises a raised base platform on which the book is supported, the raised base platform being defined by an upper surface and bounding steps on at least two sides that form a step down from the upper surface to a bottom portion of the base.

19. The case of claim 13, wherein the cover comprises a depressed inverted cover platform defined by a lower surface and bounding steps on at least two sides that form a step up from the lower surface to an upper portion of the cover.

20. The case of claim 13, further comprising a comic book disposed between the base and the cover, wherein the base is ultrasonically bonded to the cover to encapsulate the comic book and the certificate.

* * * * *